US006588077B2

(12) United States Patent
Katsuyama et al.

(10) Patent No.: US 6,588,077 B2
(45) Date of Patent: Jul. 8, 2003

(54) SEAT BELT BUCKLE

(75) Inventors: Soichi Katsuyama, Hamamatsu (JP); Shinji Mori, Niwa-gun (JP); Tetsushi Muromachi, Niwa-gun (JP)

(73) Assignee: Kabushiki Kaisha Tokai-Rika-Denki Seisakusho, Aichi-ken (JP)

( * ) Notice: Subject to any disclaimer, the term of this patent is extended or adjusted under 35 U.S.C. 154(b) by 0 days.

(21) Appl. No.: 09/872,154

(22) Filed: Jun. 4, 2001

(65) Prior Publication Data

US 2002/0178557 A1 Dec. 5, 2002

(51) Int. Cl.[7] ..... A44B 11/26
(52) U.S. Cl. ..... 24/641; 24/633
(58) Field of Search ..... 24/633, 640–642; 297/468; 280/801.1

(56) References Cited

U.S. PATENT DOCUMENTS 4,454,634 A * 6/1984 Haglund et al.
4,527,317 A * 7/1985 Straszewski et al.
5,163,207 A * 11/1992 Krautz et al.
5,195,224 A * 3/1993 Bock et al.
5,555,609 A * 9/1996 Tolfsen et al.
5,584,108 A * 12/1996 Pleyer
5,996,193 A 12/1999 Gill et al.
2001/0037544 A1 * 11/2001 Rogers, Jr. et al.

FOREIGN PATENT DOCUMENTS

EP 212507 A2 * 3/1987
EP 0 384 703 8/1990
EP 0 679 348 11/1995
WO WO00/05988 * 2/2000

* cited by examiner

*Primary Examiner*—James R. Brittain
(74) *Attorney, Agent, or Firm*—Nixon Peabody LLP; Thomas W. Cole

(57) ABSTRACT

A seat belt buckle is provided which can prevent ejection of a tongue plate caused by so-called reverse G without increasing release force for releasing a lock state. The seat belt buckle comprises a latch including a latch swinging end portion, a lock member including a lock swinging end portion, which is made to swing between a lock position, at which at the time of latching, the lock swinging end portion swings on the latch swinging end portion and engage to stop the latch swinging end portion in a state of pressing the latch swinging end portion toward engagement holes of a tongue plate and a base while pressing the same in a tongue plate insertion direction, thereby locking the latching, and a lock release position, a lock operation end portion for releasing the locking and a weight portion formed at the side of the lock swinging end portion.

16 Claims, 14 Drawing Sheets

SEAT BELT BUCKLE

BACKGROUND OF THE INVENTION

1. Field of the Invention

The present invention relates to a seat belt buckle used for a safety belt of an automobile or aircraft, and particularly to seat belt buckle in which a so-called measure to counter reverse G is taken.

2. Description of the Related Art

Generally, the above-described type of seat belt buckle is disclosed in, for example, Japanese Patent Application Laid-Open (JP-A) Nos. 60-18102, 60-75004, and 60-75005. In these buckles disclosed therein, a tongue plate is latched with the buckle such that a latch member of the buckle is engaged with a latch engaging hole of the tongue plate by inserting, into a buckle main body, an end of the tongue plate through which a seat belt (webbing) is inserted to pass. Further, the latched state is locked by a locking member and coming-off (ejection) of the tongue plate from the buckle main body is prevented.

When the locking state of the latch is cancelled by a pressing operation of a release button, latch engagement is cancelled and the tongue plate is made to come off from the buckle main body.

The above-described type of seat belt buckle is structured in such a manner that after the tongue plate is once inserted into the buckle main body completely to a lock position and locked, even if an impact is applied to the buckle, the tongue plate can be reliably held in a locked state without a latched and locked state of the tongue plate being cancelled. For example, the latch is constantly spring-urged (pressed) by a spring member toward the lock position, and the release button is returned to an original position. The release button for releasing the latched and locked state is structured so as to be able to be pressed by a small force.

Recently, safety devices have been proposed, wherein at the time of accidents such as a vehicle colliding with another vehicle or an obstacle, the buckle itself by which the tongue plate is locked, is instantaneously pulled due to instantaneous force such as explosion pressure of gunpowder and looseness of the seat belt is removed into a state of strain, thereby preventing various troubles caused by looseness of the seat belt.

However, when the buckle itself by which the tongue plate is locked is thus instantaneously pulled, so-called reverse G occurs in the buckle. Therefore, in a conventional buckle, even when the release button is not pressed, there may be a risk of the tongue plate being made to come off due to the locked state by the latch being cancelled. In other words, when the buckle itself is instantaneously and strongly pulled in a direction in which the seat belt is tensed, at the time of that the seat belt is tensed to the utmost, pulling of the buckle itself, that is, a case of a buckle main body is forcedly and rapidly stopped. Therefore, an inertia force corresponding to the total mass of the release button, locking mechanism, and the like which are accommodated within the case of the buckle main body in a state of being freely pressed, acts on the release button, locking mechanism and the like in a direction in which the lock state is released. As a result, there is a problem that the lock state may be forcedly cancelled and the tongue plate may come off form the buckle main body.

Accordingly, in order to prevent the tongue plate from coming off, in the conventional seat belt buckle, a method has been provided, wherein a spring force of the spring, which constantly urges the latch to a lock position by pressing, is increased. However, in this case, the spring becomes larger in size, and pressing force, that is, release force of the release button for releasing the locking state of the latch against spring force of the spring, may be increased.

SUMMARY OF THE INVENTION

In view of the above-described circumstances, an object of the present invention is to provide a seat belt buckle which can prevent coming-off of a tongue plate caused by so-called reverse G without increasing release force for canceling a lock state.

A first aspect of the present invention is a seat belt buckle comprising: a base including an insertion path in or from which a tongue plate having an engagement hole is inserted or removed, a pair of upright side walls, each of the side walls disposed at respective sides of the insertion path, and an engagement hole; a latch including latch lug portions supported swingably by supporting portions formed in the side walls of the base, and a latch swinging end portion swinging between a latch position at which, when the tongue plate is inserted to a latch position of the insertion path, the latch swinging end portion engagingly inserted into both of the engagement hole of the tongue plate and the engagement hole of the base so as to latch the tongue plate to the base, and a latch release position at which a latched state is released; a lock member including lug portions inserted swingably into supporting holes formed in the side walls of the base, a lock swinging end portion swinging between a lock position at which, at the time of the latched state, the lock swinging end portion latches (abuts) the latch swinging end portion in a state in which the latch swinging end portion is pressed toward both of the engagement hole of the tongue plate and the engagement hole of the base while the latch swinging end portion is pressed in a direction in which the tongue plate is inserted, thereby locking the latched state, and a lock release position at which a locked state is released; a lock sliding portion swinging together with the lock swinging end, and during swinging, sliding on the latch swinging end; a lock operation end portion which is located at the side opposite to the lock swinging end portion with respect to the lug portions interposed therebetween, and by which, when the lock operation end portion is pressed in the direction in which the tongue plate is inserted at the time of locking, the lock swinging end portion is made to swing to the lock release position, thereby releasing the lock state, and a weight portion by which a center of gravity of the lock member is made more eccentric to the lock swinging end portion than the lug portions; a latch spring elastically pressing, at the time of locking, the lock swinging end portion of the lock member substantially in the direction in which the tongue plate is inserted, to maintain the locked state; a release button including sliding portions mounted in elongated holes formed in the side walls of the base in a slidable manner in directions in and from which the tongue plate is inserted and removed, and a button which, when pressed against spring force of the latch spring in the direction in which the tongue plate is inserted, presses the lock operation end portion of the lock member in the direction in which the tongue plate is inserted, and causes the lock swinging end portion to swing in the direction from which the tongue plate is removed, thereby releasing the locked state; and an ejector which, when pressed by the tongue plate to a latch position, guides to fit the latch swinging end portion into the engagement hole of the tongue plate and the engagement hole of the base to allow latching and locking, and which, when the locked state is released by pressing the release button, presses the latch swinging end portion to the latch release position to release the latched state and removes the tongue plate from the insertion path of the base.

According to the above-described aspect of the present invention, the lock swinging end of the lock member presses to lock the latch swinging end of the latch for latching the tongue plate toward the engagement hole while pressing the same (from the front side (i.e., upstream side) to the rear side (i.e., downstream side)) in the direction in which the tongue plate is inserted. Therefore, when so-called reverse G occurs, that is, when an inertia force is generated due to rapid stopping of instantaneous pulling of the base, the inertia force acts on the lock swinging end (from the front side to the rear side) in the direction in which the tongue plate is inserted, i.e., the direction in which the latch swinging end is pressed by the lock swinging end at the time of locking. Accordingly, the lock state can be rather reinforced.

Further, the center of gravity of the lock member is located nearer the lock swinging end than the lock operation end, and the mass of the lock member at the side of the lock swinging end is made larger by the weight portion. Therefore, the inertia force acting on the lock swinging end in the locking direction can be made larger than the inertia force acting on the release button in the direction in which locking is released. Accordingly, the lock state of the latch can be held more firmly by the lock member. As a result, it is possible to reliably prevent ejection of the tongue plate when a pressing operation of the release button is not done, and safety of the seat belt buckle can be improved so much.

Moreover, the lock swinging end of the lock member for locking the latch state of the latch is urged by the latch spring in the direction in which the lock state is reinforced, i.e., the direction in which the tongue plate is inserted. In addition, no spring member for urging the latch in a direction opposite to the direction in which the tongue plate is inserted, is provided, unlike a conventional structure. Therefore, in the conventional structure, it is necessary that the lock state of the latch be released by pressing the release button against the spring force of this spring member (therefore, large pressing force of the release button is needed). However, in the present invention, it is not necessary that the lock state of the latch be released by pressing the release button against the spring force in the direction in which the tongue plate is inserted. As a result, pressing force of the release button, that is, release force can be alleviated, and safety can be further improved.

A second aspect of the present invention is a seat belt buckle according to the first aspect, wherein the supporting holes formed in the side wall of the base, into which the lug portions of the lock member are inserted, are each made circular, and at each of the side walls, an introduction groove is formed so as to communicate with the supporting hole and have an opening at an external end of the side wall.

According to the above-described aspect of the present invention, the pair of lug portions of the lock member can be simply inserted into the supporting holes in such a manner as to be put in respective open ends of the pair of introduction grooves formed in the side walls of the base and inserted along the introduction grooves. That is, assembly workability for mounting the lock member in the base can be improved.

A third aspect of the present invention is a seat belt buckle according to the first or the second aspect, wherein the lock member is structured in such a manner that the lug portions, the lock swinging end portion, the lock sliding portion, the lock operation end portion, and the weight portion are formed integrally by press forming of a metal flat plate.

According to the above-described aspect of the present invention, the lock member is entirely formed by press forming of a metal flat plate. Therefore, as compared with a case in which the lock member is formed from sintered metal, improvement in simplicity of manufacture and reduction in cost can be both achieved.

A fourth aspect of the present invention is a seat belt buckle according to any one of the first to third aspect, wherein the lock sliding portion includes two lock sliding portions which are respectively formed at both ends of the lock swinging end portion in a transverse direction of the lock member, and a sliding surface of each of the lock sliding portions, which slides on respective transverse-direction ends of the latch swinging end portion in directions in and from which the tongue plate is inserted and removed, is formed into a circular arc.

According to the above-described aspect of the present invention, the lock sliding portions of the lock member sliding on the latch swinging end of the latch are respectively formed at two places, i.e., at both transverse-direction ends of the lock member. Therefore, as compared with a case of sliding at one place, a sliding operation when the sliding portions of the lock swinging end slide on both transverse-direction ends of the latch swinging end, can be stabilized, and the locked state of the latch can also be stabilized. As a result, safety can be improved.

Further, the lock sliding portions sliding on both transverse-direction ends of the latch swinging end each has the circular arc-shaped sliding surface. Therefore, the each contact area of the sliding surface decreases and sliding loss can be reduced. As a result, force by which the tongue plate is inserted into the insertion path to allow swinging of the lock swinging end, and pressing force of the release button (i.e., release force) can be alleviated.

A fifth aspect of the present invention is a seat belt buckle according to any one of the first to fourth aspect, wherein the lock sliding portions of the lock member each include a sliding surface which abuts against and slides on the latch swinging end portion when the latched state is released, and the sliding surface is formed as a circular-arc surface recessed inward.

According to the above-described aspect of the present invention, in a latch release state, the latch swinging end abuts against respective one surfaces, for example, rear surfaces, of the lock sliding portions of the lock member and rotates around the central axis of swinging of the latch swinging end. The sliding surface of each lock sliding portion is formed into a concave arcuate surface, and therefore, the latch swinging end can rotate smoothly around the central axis of swinging thereof in a state of slide-contacting the concave arcuate surfaces. Accordingly, the sliding loss of the latch swinging end can be reduced. Further, the latch sliding portions are each constantly made to partially slide-contact one surface of the lock sliding portion. Therefore, shaking of the latch swinging end (unstability of the latch swinging end) is prevented and a latch release operation can be stabilized.

A sixth aspect of the present invention is a seat belt buckle according to any one of the first to fifth aspect, wherein the lock member is mounted on a stopper made of resin and having a spring-mounting notch portion, and one end of a latch spring is engaged with the spring-mounting notch portion of the stopper.

According to the above-described aspect of the present invention, the lock member, the stopper, and the latch spring are in advance assembled in such a manner that the stopper made of synthetic resin is mounted in the lock member and one end of the latch spring is engaged with the supporting notches of the stopper, and the prefabricated component thus formed can be mounted in the base. As a result, the number of assembling processes of the seat belt buckle can be reduced and assembly workability for mounting the lock member in the base can be improved.

Further, the stopper is made of synthetic resin having elasticity, and therefore, it can be mounted, by fitting, in the lock member made of metal simply, reliably, and rapidly. In addition, the degree at which both members are mounted integrally and closely can be increased. Moreover, the latch spring inserted in the supporting notches of the stopper can be simply and reliably mounted in the lock member at a predetermined mounting position with high accuracy.

A seventh aspect of the present invention is a seat belt buckle according to the sixth aspect, wherein the stopper includes stopper portions formed integrally therewith and abutting against the sliding portions of the release button in the locked state.

According to the above-described aspect of the present invention, the stopper portions of the stopper engaged with and mounted in the lock member abut against the sliding portions of the release button at the time of locking. Therefore, it is possible to prevent the lock state from being released without pressing the release button, which is caused by shaking (usstability) of the lock member at the time of locking. Safety can be improved so much.

A eighth aspect of the present invention is a seat belt buckle according to the first or second aspect, wherein the lock member comprises a lock-member main body portion including lug portions, lock swinging end portion, a lock operation end portion, and stopper portions abutting against the sliding portions of the release button in the locked state, all of which are formed integrally by press forming of a metal flat plate, and a lock-member weight portion including a weight portion and a pair of lock sliding portions located at both transverse-direction ends of the weight portion, the weight portion and the lock sliding portions being formed integrally by press forming of a metal flat plate, wherein lock-member main body portion further includes spring-mounting notch portion in which one end of the latch spring is engaged, and the lock-member weight portion is attachably-and-removably mounted in the lock-member main body portion.

According to the above-described aspect of the present invention, the lock-member weight portion attachably and removably mounted in the lock-member main body portion is made of metal. Therefore, mechanical strength can be increased and the mass of the weight portion itself can also be increased.

As a result, the mass at the side of the lock swinging end can be made larger than the mass at the side of the lock operation end. Therefore, when so-called reverse G occurs, the inertia force acting on the lock swinging end in the locking direction can be increased still more. Accordingly, the lock state of the latch can be held more firmly by the lock member. Therefore, it is possible to prevent ejection of the tongue plate more reliably when a pressing operation of the release button is not done, and safety of the seat belt buckle can be improved so much.

Further, the lock-member main body portion, the lock-member weight portion, and the latch spring are in advance assembled in such a manner that the lock-member weight portion is mounted in the lock-member main body portion and one end of the latch spring is engaged with the mounting notches of the lock-member main body portion, and the prefabricated component comprised of the three portions can be mounted in the base. As a result, the number of assembling processes of the seat belt buckle decreases and assembly workability for mounting the lock member in the base can be improved.

The pair of lock sliding portions of the lock-member weight portion sliding on the latch swinging end are respectively formed at two places, i.e., at both transverse-direction ends of the lock-member weight portion. Therefore, as compared with a case of sliding at one place, a sliding operation when the pair of lock sliding portions slide on both transverse-direction ends of the latch swinging end, can be stabilized, and the locked state of the latch can also be stabilized. As a result, safety can be improved.

A ninth aspect of the present invention is a seat belt buckle according to the eighth aspect, wherein the lock-member main body portion includes the stopper portions formed integrally therewith and abutting against the sliding portions of the release button in the locked state.

According to the above-described aspect of the present invention, the stopper portions formed integrally with the lock-member main body portion abut against the sliding portions of the release button at the time of locking. Therefore, it is possible to prevent the lock state from being released without pressing the release button, which is caused by shaking (for example, unstsbility) of the lock member at the time of locking, and safety can be improved so much.

Further, the stopper portions are formed integrally with the lock-member main body portion made of metal. Therefore, the strength of the stopper portions can be increased, and reliability of stopper function of the stopper portions can be improved so much. Accordingly, safety of the seat belt buckle can be improved.

A tenth aspect of the present invention is a seat belt buckle according to the eighth or ninth aspect, wherein the lock sliding portions of the lock-member weight portion each include a sliding surface which slides on the latch swinging end portion in directions in and from which the tongue plate is inserted and removed, and each sliding surface is formed into a circular arc.

According to the above-described aspect of the present invention, the pair of lock sliding portions sliding on both transverse-direction ends of the latch swinging end each have a sliding surface formed into a circular arc. Therefore, a contact area of the sliding surface decreases and the sliding loss can be reduced. As a result, force by which the tongue plate is inserted into the insertion path to allow swinging of the lock swinging end, and pressing force of the release button (i.e., release force) can be alleviated.

A eleventh aspect of the present invention is a seat belt buckle according to any one of the first to tenth aspect, wherein the lock member includes an insertion hole at the lock operation end portion, and the release button includes an inserting projection which is inserted into the insertion hole of the lock operation end portion at a time of pressing the release button, and at the same time, presses the lock operation end portion so as to swing the lock swinging end portion to the lock release position while gradually lifting the lock swinging end portion in a direction opposite to a direction in which it is pressed toward the latch swinging end portion.

According to the above-described aspect of the present invention, when the release button is pressed, the inserting projection of the release button is gradually inserted into the insertion hole of the lock member and the lock member is gradually lifted by an inclined surface of the inserting projection in a direction opposite to a pressing direction toward the latch swinging end. The pressing force is reduced, and thereafter, the lock swinging end of the lock member are made to swing to the lock release position. Accordingly, the pressing force of the release button, that is, release force can be alleviated still further.

A twelfth aspect of the present invention is a seat belt buckle according to any one of the first to eleventh aspect, wherein the sliding portions of the release button are provided at respective ends of a pair of arms formed so as to hold therein the side walls of the base from externally, and a guide groove is formed in the each of the sliding portions in such a manner that an open edge of an elongated hole provided in each of the side walls of the base is slidably fitted therein.

According to the above-described aspect of the present invention, the pair of arms of the release button are formed in the transverse direction of the release button so as to hold therein the pair of side walls of the base from externally, and the sliding portions at respective ends of the arms are made to slide in the elongated holes of the side walls of the base. Therefore, the sliding operation of the sliding portions when the release button is pressed can be stabilized in the transverse direction of the release button and can be made smooth.

Further, the sliding portions of the release button, which is fitted slidably into the elongated hole of the base, are each provided with a guide groove into which an open edge of the elongated hole is slidably fitted. Therefore, the open edge of the elongated hole can be slidably held by the pair of facing walls of the guide groove. As a result, removal of the sliding portion from the elongated hole can be prevented.

A thirteenth aspect of the present invention is a seat belt buckle according to any one of the first to twelfth aspect, wherein the release button is entirely formed from synthetic resin.

A fourteenth aspect of the present invention is a seat belt comprising: a base including an insertion path in or from which a tongue plate having an engagement hole is inserted or removed, and a pair of upright side walls, each of the side walls disposed at respective sides of the insertion path; a latch supported swingably at the side walls of the base, and swinging between a latch position at which, when the tongue plate is inserted to a latch position of the insertion path, the latch engagingly inserted into the engagement hole of the tongue plate so as to latch the tongue plate, and a latch release position at which a latched state is released; a lock member including a lock swinging end portion swinging between a lock position at which, at the time of the latched state, the lock swinging end portion latches (abuts) the latch in a state in which the latch is pressed toward the engagement hole of the tongue plate while the latch swinging end portion is pressed in a direction in which the tongue plate is inserted, thereby locking the latched state, and a lock release position at which a locked state is released; a lock sliding portion swinging together with the lock swinging end, and during swinging, sliding on the latch; a lock operation end portion by which, when the lock operation end portion is pressed in the direction in which the tongue plate is inserted at the time of locking, the lock swinging end portion is made to swing to the lock release position, thereby releasing the locked state, and a weight portion by which a center of gravity of the lock member is made eccentric to a lock swinging end portion side; a latch spring elastically pressing, at the time of locking, the lock swinging end portion of the lock member substantially in the direction in which the tongue plate is inserted, to maintain the locked state; a release button including a button which presses the lock operation end portion of the lock member in the direction in which the tongue plate is inserted, and causes the lock swinging end portion to swing in the direction from which the tongue plate is removed, thereby releasing the locked state; and an ejector which, when the locked state is released by pressing the release button, presses the latch to the latch release position to release the latched state and removes the tongue plate from the insertion path of the base.

According to the above-described aspect of the present invention, the release button is entirely lightened by being formed from synthetic resin. Therefore, when so-called reverse G occurs, the inertia force acting on the release button in the pressing direction can be reduced greatly as compared with the inertia force acting on the lock swinging end of the lock member in the locking direction. As a result, it is also possible to prevent ejection of the tongue plate from the buckle when so-called reverse G occurs. Further, safety can be improved.

DESCRIPTION OF THE PREFERRED EMBODIMENTS

Figure 1:
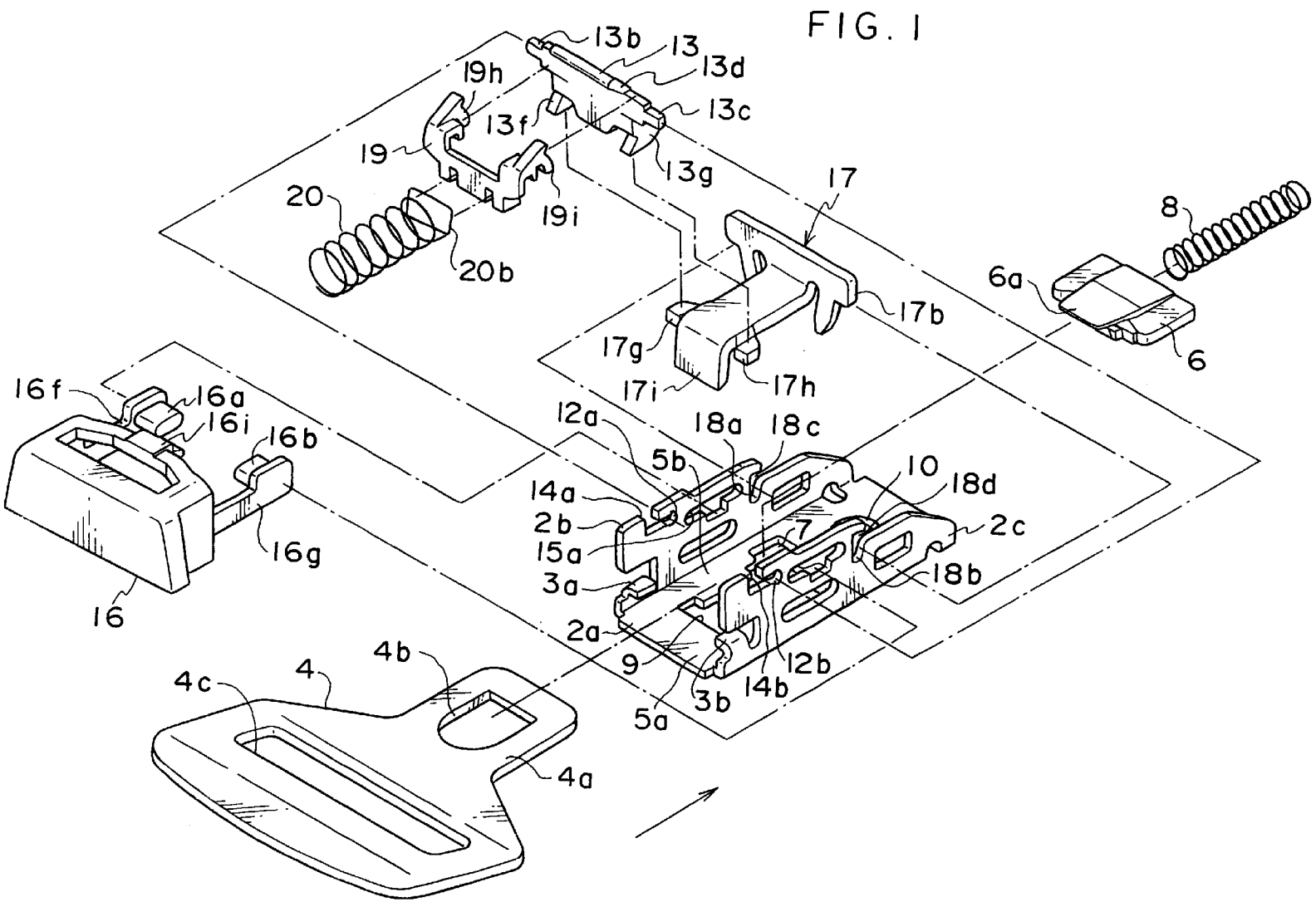
FIG. 1 is an exploded perspective view of a seat belt buckle according to a first embodiment of the present invention.

A description will be hereinafter given of an embodiment of the present invention with reference to FIGS. 1 to 18. Note that the same or equivalent members in these drawings will be denoted by the same reference numerals.

Figure 2:
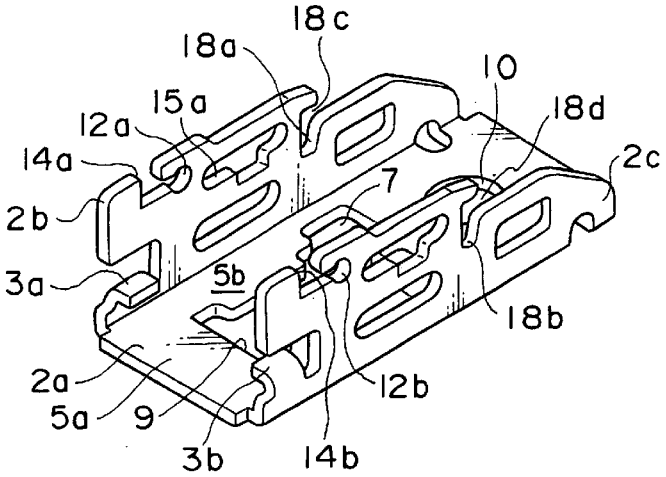
FIG. 2 is a perspective view of a base shown in FIG. 1.
Figure 3:
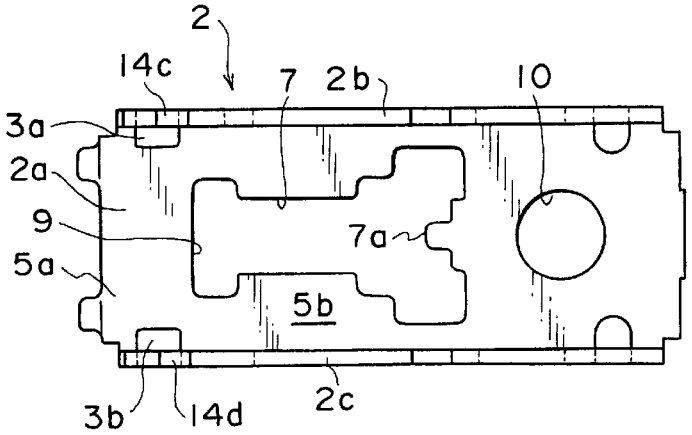
FIG. 3 is a plan view of the base shown in FIG. 1.
Figure 4:
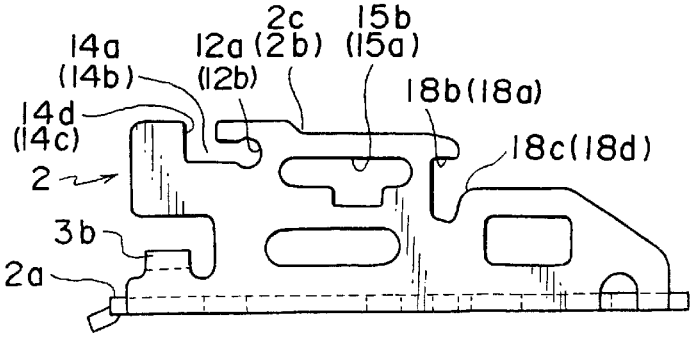
FIG. 4 is a side view of the base shown in FIG. 1.

FIG. 1 is an exploded perspective view showing an overall structure of a seat belt buckle 1 according to an embodiment of the present invention. FIG. 2 is a perspective view of a base of the seat belt buckle, and FIGS. 3 and 4 are a plan view and a side view, respectively, of the base. The seat belt buckle 1 includes a base 2 formed into a substantially U-shaped cross sectional configuration by press forming of a metal flat plate.

As shown in FIGS. 1 to 4, the base 2 includes a bottom portion 2*a* formed into a flat plate, and a pair of side walls 2*b* and 2*c* provided by making both ends of the bottom portion 2*a* in the widthwise direction thereof, upright substantially at a right angle and formed integrally with the bottom portion 2*a*. At the side of the front end of the bottom portion 2*a* (that is, at the side of the left-handed end thereof in FIG. 1), a cut of a predetermined length is formed in a lower end at the front end of each of the pair of side walls 2*b* and 2*c* in a horizontal direction from the front end thereof, thereby cut portions are formed. The cut portions are each bent inside substantially at a right angle to form a pair of tongue-shaped portions 3*a* and 3*b*. A clearance between the tongue-shaped portions 3*a* and 3*b*, and the inner surface of the bottom portion 2*a* is formed into an opening 5*a* into which an inserting end portion 4*a* of a tongue plate 4 is inserted along an inner bottom surface of the bottom portion 2*a*, and an insertion path 5*b* provided at an inner side of the opening 5*a* is formed. The tongue plate 4 includes an engaging hole 4*b* passing through the inserting end portion 4*a* in the direction of thickness thereof, and also includes, at another end portion which is wide end portion, a rectangular insertion hole 4*c* through which a webbing (not shown) serving as a seat belt is inserted in a loose state.

A slide guide hole 7 is formed at a central portion of the bottom 2*a* of the base 2 so as to pass through in the direction of thickness of the base 2. The slide guide hole 7 is structured in such a manner that an ejector 6 of a push-out mechanism, which will be described later, slides so as to freely reciprocate along a direction in which the tongue plate 4 is inserted, which direction is indicated by the arrow shown in FIG. 1. A small protrusion 7*a* is formed at a transverse-direction intermediate portion at the rear end (that is, a right-handed end in FIG. 1) of the slide guide hole 7 so as to project toward an inner side of the slide guide hole. One end of a coil type ejector spring 8 which constantly urges the ejector 6 toward the left side of FIG. 1, is exteriorly fitted and fixed to the small protrusion 7*a*. Further, an engagement hole 9 is formed at the front end (that is, the left-handed end in FIG. 1) of the slide guide hole 7 integrally and coaxially therewith. The engagement hole 9 is formed into a rectangular through hole of which transverse dimension is a little larger than that of the slide guide hole 7.

The ejector 6 is entirely formed in an integral manner by molding or the like of synthetic resin. The front end of the ejector 6 is formed as a concave arcuate surface which conforms to a convex arcuate surface of the inserting end portion 4*a* of the tongue plate 4. The concave arcuate surface of the ejector 6 is pressed by the tongue plate 4 in the direction in which the tongue plate 4 is inserted, and slides on the bottom portion 2*a* along the slide guide hole 7. Further, a tongue-shaped portion 6*a* is formed integrally with a front end portion of the ejector 6 so as to protrude toward the front. The tongue-shaped portion 6*a* is provided so as to close an upper surface of the engagement hole 9 of the base 2 by slipping into a lower surface of a latch swinging end 17*i* of a latch 17, which will be described later, when latching and locking are canceled.

Figure 16:
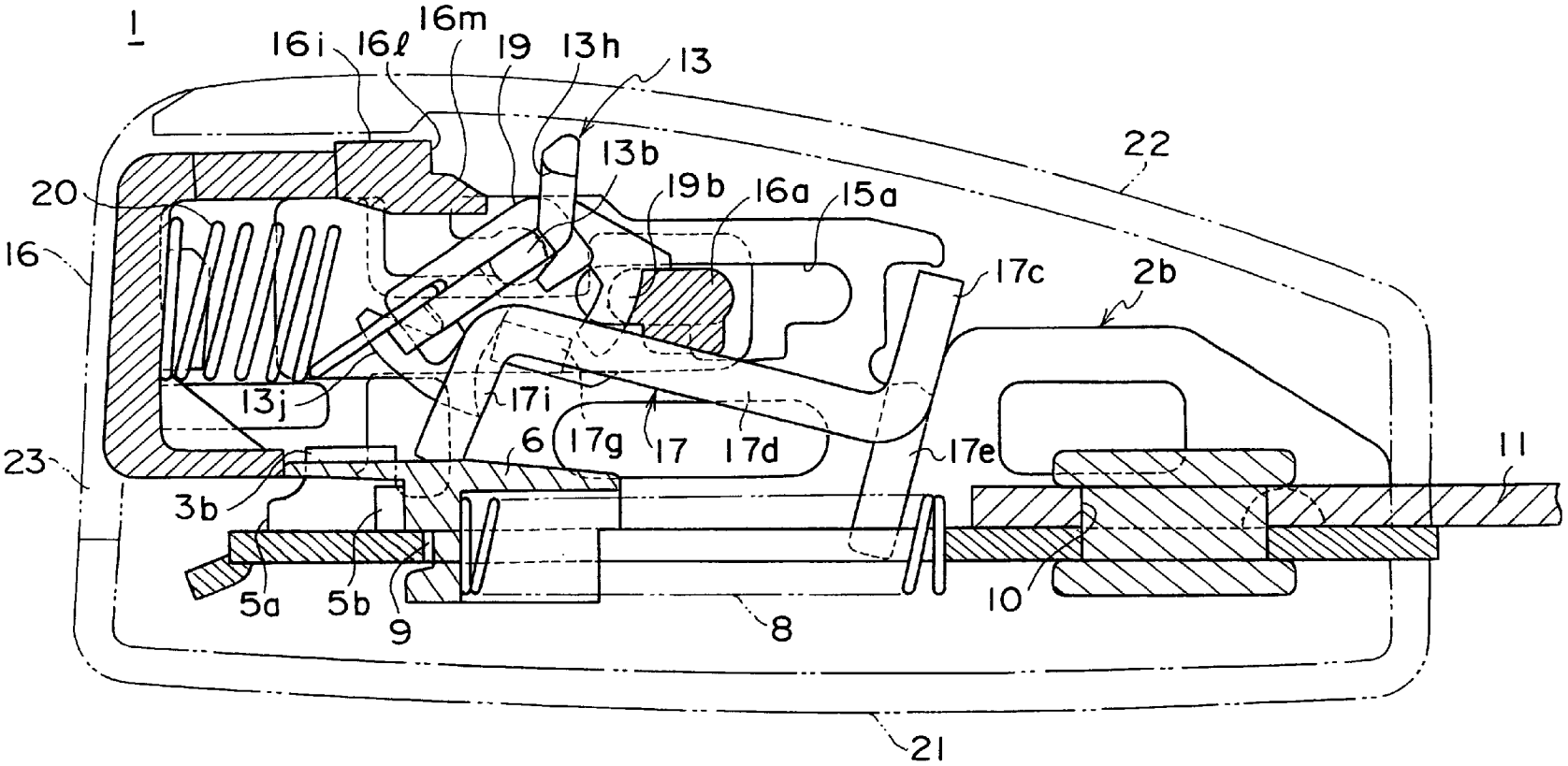
FIG. 16 is a side sectional view which schematically shows a state before a tongue plate is inserted into an insertion opening of the seat belt buckle shown in FIG. 1.
Figure 17:
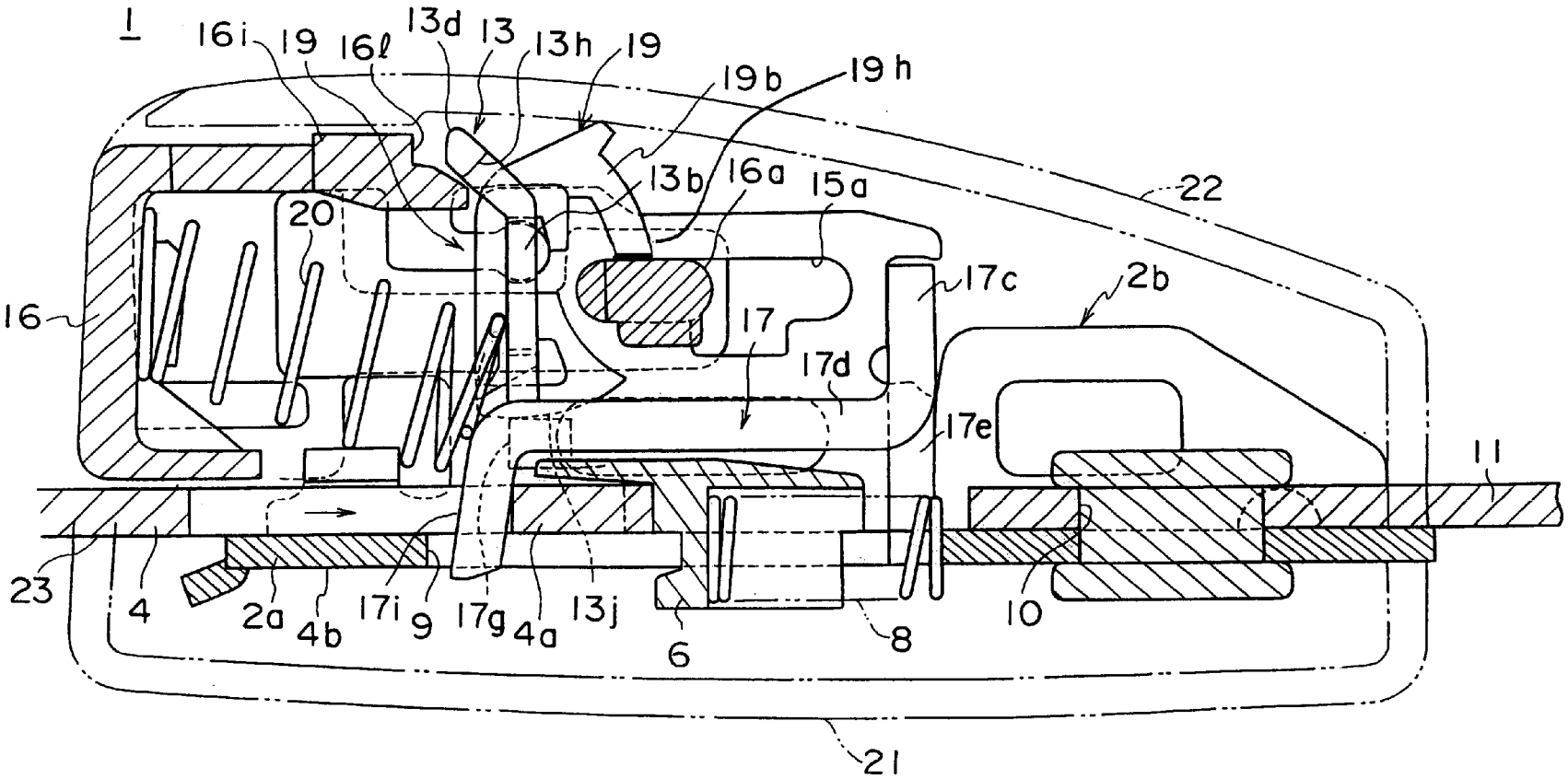
FIG. 17 is a side sectional view which schematically shows a state in which the seat belt buckle shown in FIG. 1 is locked.
Figure 18:
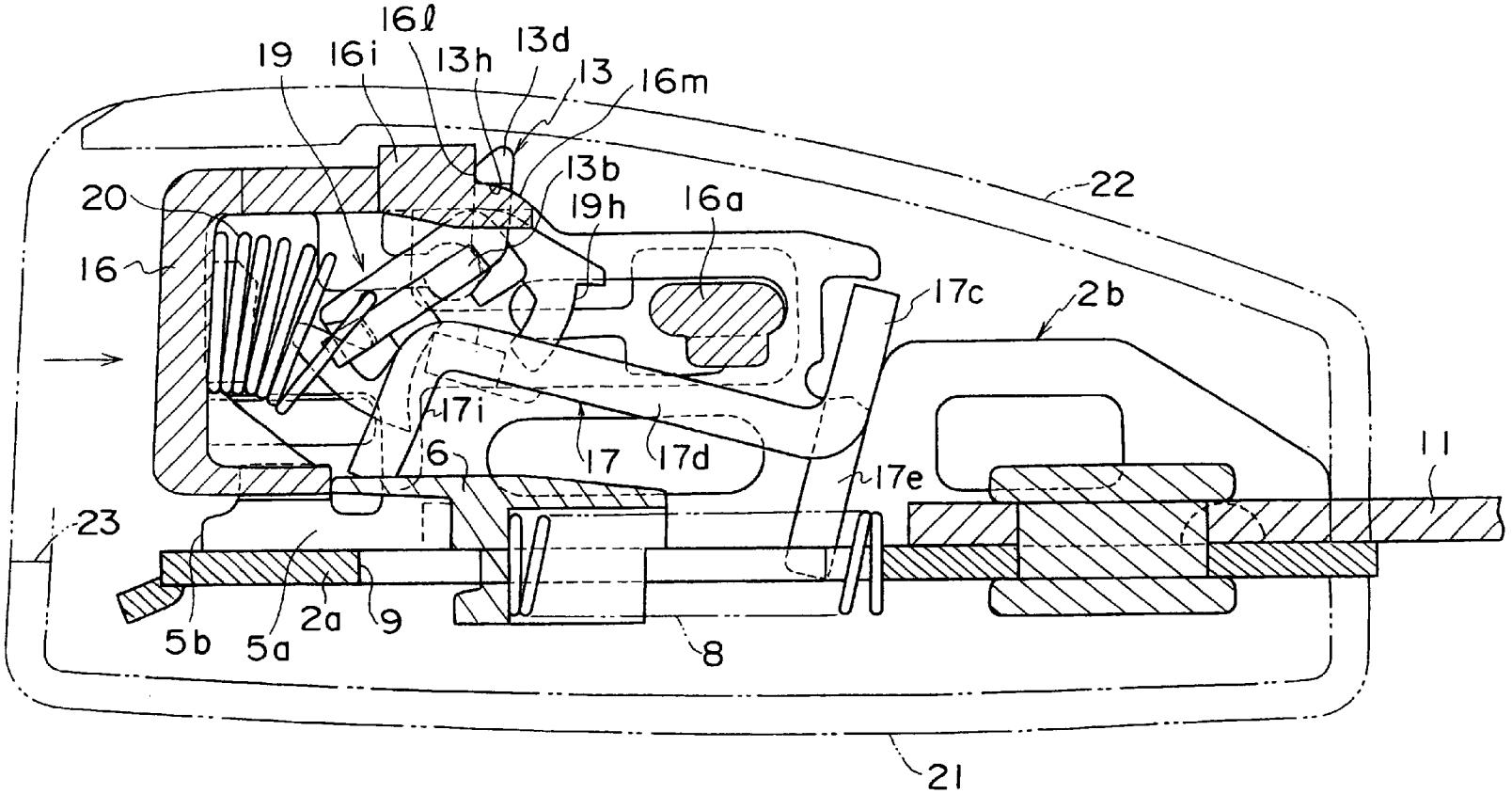
FIG. 18 is a side sectional view which schematically shows a state in which a lock state is cancelled by pressing a release button of the seat belt buckle shown in FIG. 1.

A mounting hole 10 which is formed as, for example, a circular through hole, is provided at a rear end of the bottom portion 2*a* of the base 2. A tractive plate 11 formed from a metal flat plate or the like (which is shown in FIGS. 16 to 18) is fixed to the mounting hole 10 by a rivet or the like. The tractive plate 11 is instantaneously pulled rearward (that is, toward the right side in FIG. 1) by a tractor (not shown) due to instantaneous force such as explosion pressure of gunpowder when necessary (for example, at the time of collision of vehicles), and a webbing (not shown) passing through the insertion hole 4*c* of the tongue plate 4 is thereby pulled and strained by removing looseness produced therein.

A pair of circular supporting holes 12*a* and 12*b* are respectively at the front side of the pair of side walls 2*b* and 2*c* at middle-height positions so as to face each other in the transverse direction of the base 2. These supporting holes 12*a* and 12*b* are provided such that a pair of lug portions 13*b* and 13*c* serving as a central axis of swinging of a lock member 13, which will be described later, are swingably inserted into and supported by the supporting holes.

A pair of introduction grooves 14*a* and 14*b* which respectively communicate with and are integral with the above-described supporting holes 12*a* and 12*b*, are respectively formed in the side walls 2*b* and 2*c* so as to face each other in the transverse direction. These introduction grooves 14*a* and 14*b* are each formed into a substantially L-shaped configuration in which a transverse dimension of the introduction groove is a little smaller than the diameter of each supporting hole 12*a*, 12*b* and is a little larger than a plate thickness of the lock member 13. An upper end of the L-shaped configuration of each introducing groove 14*a*, 14*b* forms an opening 14*c*, 14*d* at an upper end of the side wall 2*b*, 2*c* in FIG. 1. The lug portions 13*b* and 13*c* of the lock member 13 can respectively be introduced into the supporting holes 12*a* and 12*b* through the introduction grooves 14*a* and 14*b*.

A pair of slide grooves 15*a* and 15*b* extending in the longitudinal direction of the base 2 are respectively formed in the pair of side walls 2*b* and 2*c* at the longitudinal-direction intermediate portions thereof so as to face each other in the transverse direction of the base. A pair of sliding portions 16*a* and 16*b* of a release button 16, which will be described later, are slidably fitted into the slide grooves 15*a* and 15*b*, respectively.

Further, square holes 18*a* and 18*b* each having a substantially rectangular configuration when seen from the side, are respectively formed in rear and middle high (step) portions in the pair of side walls 2*b* and 2*c* of the base 2, and are provided in such a manner that a pair of lug portions 17*b* and 17*c* of a latch 17 made of metal, which will be described later, are fitted into the square holes swingably around the central shafts thereof. Respective one surfaces of the square holes 18*a* and 18*b*, namely, respective one surfaces thereof at the right side of FIGS. 1 and 4 are formed as openings 18*c* and 18*d*, and the above-described lug portions 17*a* and 17*b* of the latch 17 are inserted from the openings 18*c* and 18*d*. Moreover, the side walls 2*b* and 2*c* of the base 2 includes a plurality of holes having various shapes for the purpose of lightening the base 2.

Figure 5:
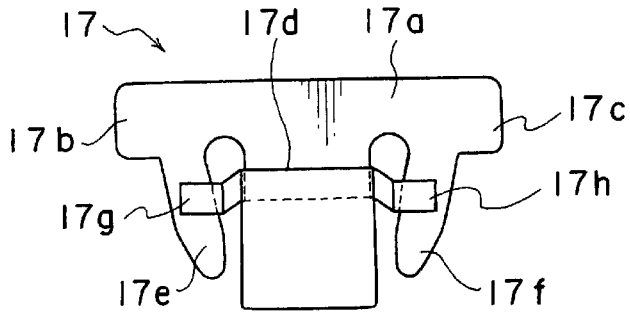
FIG. 5 is a front view of a latch shown in FIG. 1.
Figure 6:
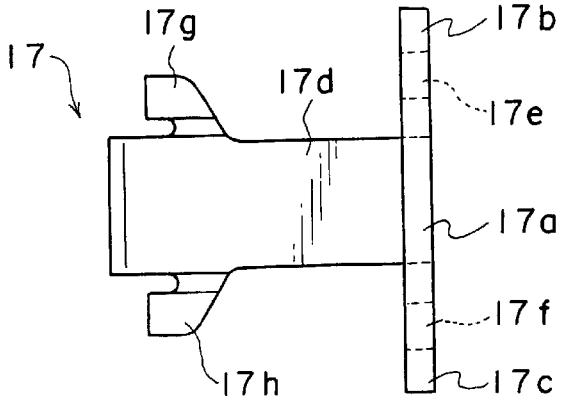
FIG. 6 is a plan view of the latch shown in FIG. 1.
Figure 7:
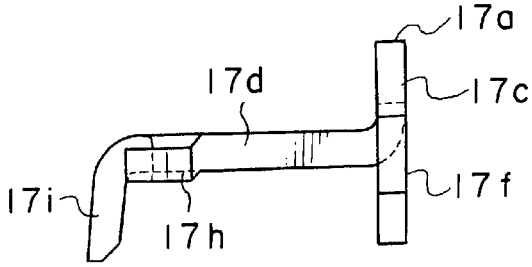
FIG. 7 is a side view of the latch shown in FIG. 1.

FIGS. 5, 6, and 7 are a front view, a plan view, and a side view of the latch 17, respectively. As illustrated in these drawings, the latch 17 includes a rectangular main body 17*a* of which transverse dimension is slightly larger than that of the base 2, the pair of lug portions 17*b* and 17*c* formed integrally with both transverse-direction ends of the main body 17*a* and inserted swingably into the pair of square holes 18*a* and 18*b* of the base 2, a substantially L-shaped hooked portion 17*d* protruding from a transverse-direction intermediate portion at a lower end (in FIG. 5) of the main body 17*a* in one direction (that is, toward the left side in FIGS. 6 and 7), a pair of leg portions 17*e* and 17*f* protruding downward (in FIG. 5) from the lower end of the main body 17*a* at both sides of the hooked portion 17*d*, and a pair of sliding portion 17*g* and 17*h* each having a rectangular configuration when shown by the plan view and protruding outward at both sides of the hooked portion 17*d* as shown in FIG. 6. These component portions are formed integrally and connected together.

The pair of leg portions 17*e* and 17*f* of the latch 17 function as stoppers when the latch 17 is pressed by a rear end (that is, an end at the right side in FIG. 1) of the ejector 6 from the direction, indicated by the arrow in FIG. 1, in which the tongue plate is inserted.

Figure 8:
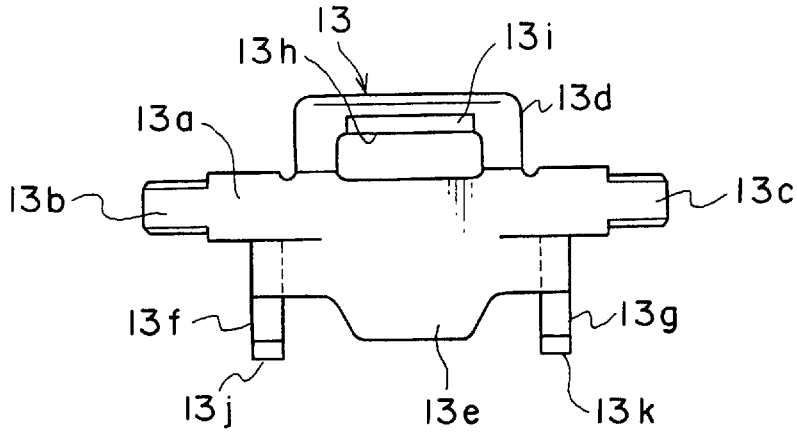
FIG. 8 is a front view of a lock member shown in FIG. 1.
Figure 9:
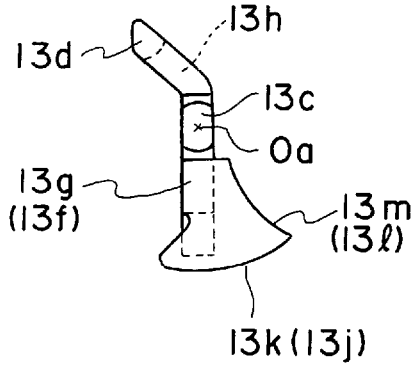
FIG. 9 is a side view of the lock member shown in FIG. 1.

FIGS. 8 and 9 are a front view and a side view of the lock member 13 respectively. The lock member 13 is formed integrally by press forming of a metal flat plate or the like. That is, the locking member 13 includes a rectangular main body 13*a* of which transverse dimension is longer than the vertical dimension and is slightly longer than the transverse dimension of the base 2, a pair of lug portions 13*b* and 13*c* formed integrally with both transverse-direction ends of the main body 13*a* and inserted swingably into the pair of circular supporting holes 12*a* and 12*b* of the base 2, a rectangular lock operation end 13*d* of which transverse dimension is longer than the vertical dimension and which protrudes upward in FIG. 8 from the transverse-direction intermediate portion at the upper end of the main body 13*a*, a weight portion 13*e* having a substantially rectangular configuration and protruding downward in FIG. 8 from the transverse-direction intermediate portion at the lower end of the main body 13*a*, and a pair of lock swinging ends 13*f* and 13*g* protruding downward from the transverse-direction side portions (in FIG. 8) of the weight portion 13*e*.

As shown in FIG. 8, the lock operation end 13*d* of the lock member 13 includes a rectangular insertion hole 13*h*, of which transverse dimension is longer than the vertical dimension, at the central portion thereof, and an open upper edge (in FIG. 8) of the insertion hole 13*h* is formed as a tapered surface 13*i* expanding toward the side in which the tongue plate 14 is inserted (that is, toward the left side in FIG. 9). Further, the lock operation end 13*d* is bent so as to be inclined at a predetermined angle toward at the front (at the left side in FIG. 9) with respect to the central axis Oa of swinging of the pair of lug portions 13*b* and 13*c*, that is, toward the side in which the tongue plate 4 is inserted.

As shown in FIG. 9, the pair of lock swinging ends 13*f* and 13*g* of the lock member 13 are each formed substantially into a trapezoid of which transverse dimension gradually decreases toward the upper side (in FIG. 9) when seen from the side. The lower bottom surface of the trapezoid is formed as a circular arc surface 13*j*, 13*k* protruding downward, and the rear surface (i.e., the surface at the right side in FIG. 9) of the trapezoid is formed as a concave arcuate surface 13*l*, 13*m*. The circular arc surfaces 13*j* and 13*k* of the lock swinging ends 13*f* and 13*g* are respectively made to move slidably on flat surfaces of the pair of sliding portions 17*g* and 17*h* of the latch 17 shown in FIG. 6. Further, at the time of locking being cancelled, respective front ends of the sliding portions 17*g* and 17*h* of the latch 17 slide on and contact the concave arcuate surfaces 13*l* and 13*m* of the lock swinging ends 13*f* and 13*g* to thereby guide swinging around a central axis of swinging of the latch engagement end 17*i*.

Figure 10:
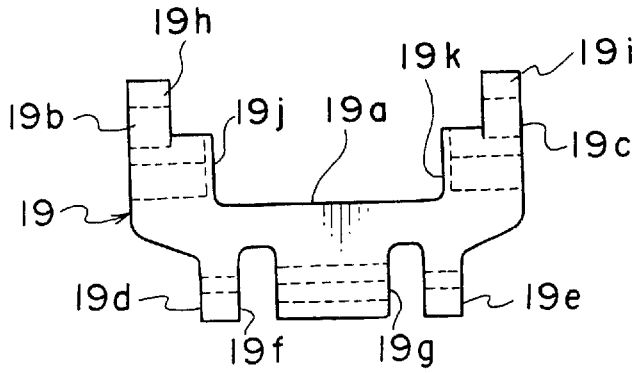
FIG. 10 is a front view of a stopper shown in FIG. 1.
Figure 11:
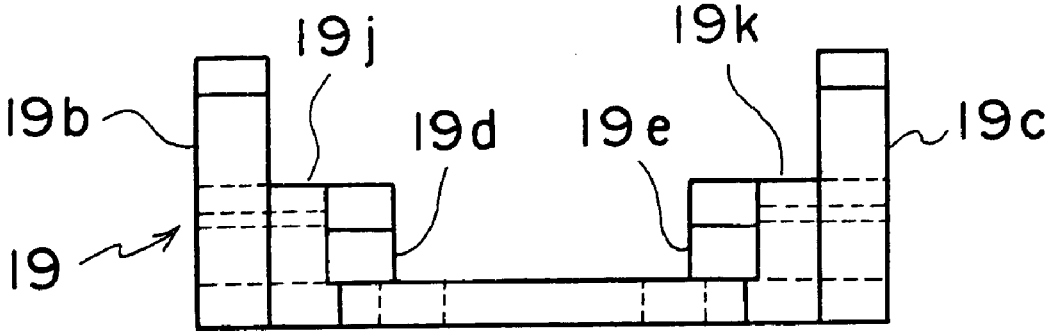
FIG. 11 is a plan view of the stopper shown in FIG. 1.
Figure 12:
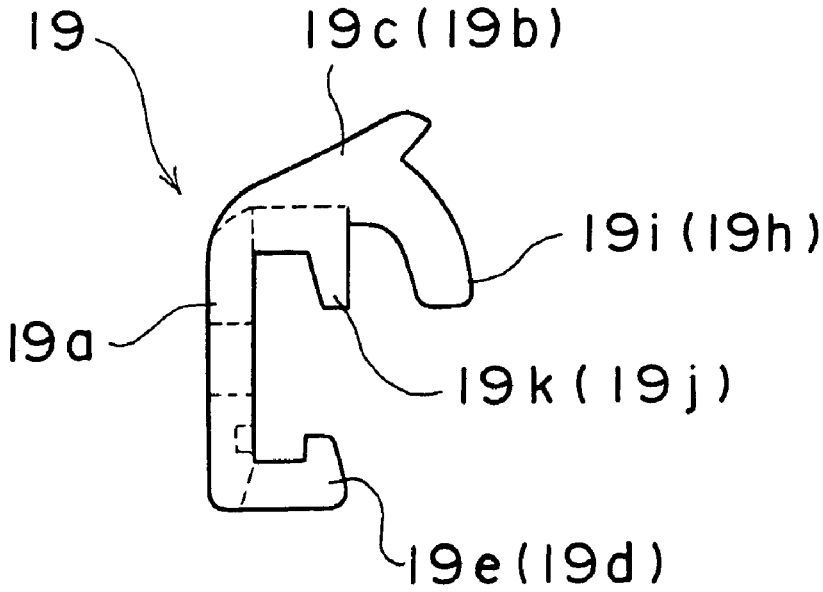
FIG. 12 is a side view of the stopper shown in FIG. 1.

FIG. 10 is a front view of a stopper 19 made of synthetic resin, which stopper is mounted by fitting at the front surface of the lock member 13, that is, at one surface of the lock member 13 at the position 5*a* side of the tongue plate insertion path 5*b*. FIGS. 11 and 12 are a plan view and a side view of the stopper 19, respectively. The stopper 19 is entirely formed integrally by molding of synthetic resin, or the like. Namely, the stopper 19 is structured in such a manner that a rectangular main body 19*a* of which transverse dimension is longer than the vertical one, a pair of arms 19*b* and 19*c* each having a substantially triangular configuration when seen from the side and protruding rearward from both transverse-direction ends at the upper end of the main body 19*a*, and a pair of supporting legs 19*d* and 19*e* each having a hooked configuration when seen from the side and protruding rearward from both transverse-direction ends at the lower end of the main body 19*a* are formed integrally from synthetic resin. A pair of spring-mounting notches 19*f* and 19*g* of which lower sides are open, are formed at the lower end of the main body 19*a*.

As shown in FIG. 12, substantially circular arc-shaped stopper portions 19*h* and 19*i* protruding outward when seen from the side, are respectively formed integrally with the arms 19*b* and 19*c* of the stopper 19 at the rear ends of the arms. A pair of supporting protrusions 19*j* and 19*k* are formed integrally with the stopper portions 19*h* and 19*i* respectively, which protrusions are formed at an inner side of the stopper portions 19*h* and 19*i* and protrude downward at the rear side of the upper end at transverse-direction both sides of the lock member main body 13*a* so as to catch the lock member 13 in the direction of plate thickness thereof.

Figure 13A:
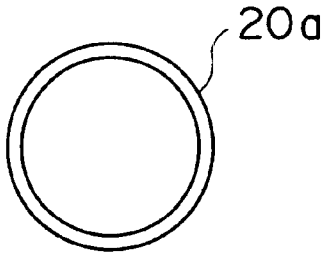
FIG. 13A is a left side view of a latch spring shown in FIG. 1.
Figure 13B:
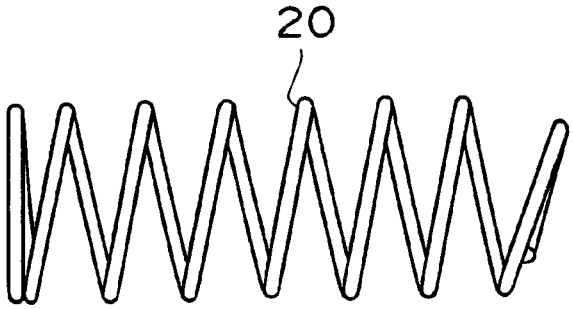
FIG. 13B is a front view of the latch spring.
Figure 13C:
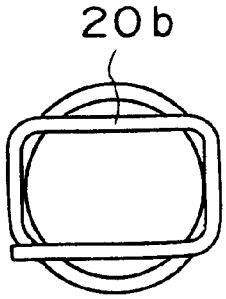
FIG. 13C is a right side view of the latch spring.

FIG. 13A is a left side view of the latch spring 20. FIGS. 13B and 13C are a front view and a right side view of the latch spring 20 respectively. The latch spring 20 is a coil spring having a predetermined diameter. One end of the latch spring 20 is formed into a circle as shown in FIG. 13A, and the other end thereof is formed into a rectangle as shown in FIG. 13C. The latch spring 20 is mounted in the stopper 19 in such a manner that transverse-direction both ends of the rectangular end 20*b* of the spring are respectively fitted into the spring-mounting notches 19*f* and 19*g* of the stopper 19.

In other words, the latch spring 20 can be simply and reliably mounted in the lock member 13 in such a manner that the stopper 19 is fitted and mounted at the front surface of the lock member 13 and the rectangular end 20*b* of the latch spring 20 is engaged and fitted into the spring-mounting notches 19*f* and 19*g* of the stopper 19 from the openings at the lower surface. The lock member 13, the stopper 19, and the latch spring 20 are in advance assembled together to be formed as a modular (prefabricated) component.

Figure 14:
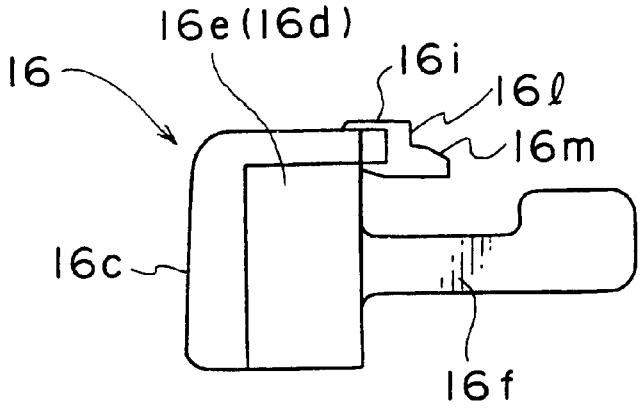
FIG. 14 is a side view of a release button shown in FIG. 1.
Figure 15:
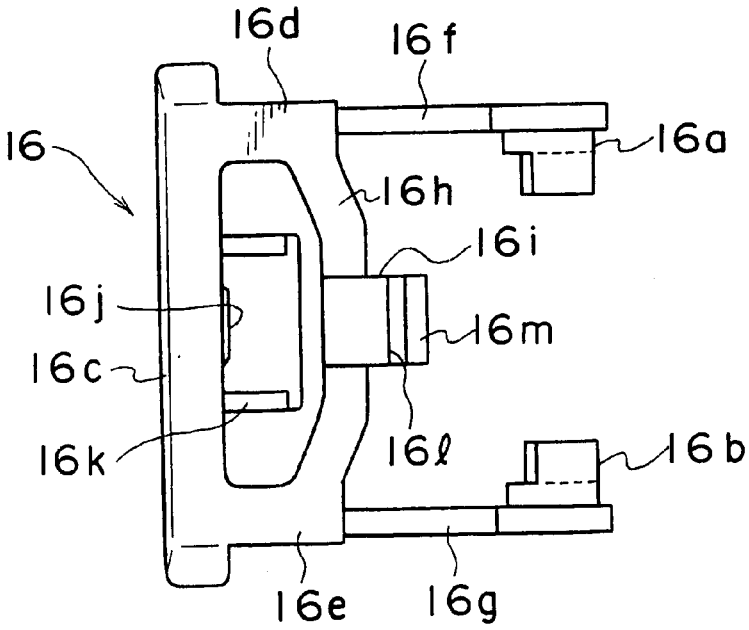
FIG. 15 is a plan view of the release button shown in FIG. 1.

FIGS. 14 and 15 are a side view and a plan view of the release button 16. The release button 16 is entirely formed integrally by molding of synthetic resin, or the like. That is, the release button 16 includes a substantially C-shaped main body 16*c*, a pair of arms 16*f* and 16*g* protruding rearward a predetermined length from facing side walls 16*d* and 16*e* of the main body 16*c* and formed so as to hold therein the side walls 2*b* and 2*c* of the base 2 from externally, a pair of sliding portions 16*a* and 16*b* protruding inward in the direction in which the arms 16*f* and 16*g* face each other, at the respective protruding ends of the arms 16*f* and 16*g*, a connecting portion 16*h* for connecting respective distal ends of the side walls 16*d* and 16*e* in the direction in which the side walls face each other, an inserting projection 16*i* which projects rearward at a longitudinal-direction intermediate portion of the connecting portion 16*h*, a spring-fixing projection 16*j* projecting at a substantially central portion on the inner surface of the main body 16*c* and fixing the latch spring 20 with a circular end 20*a* of the latch spring 20 being externally engaged therewith, and a circular arc-shaped insertion guide 16*k* formed to protrude from the inner surface of the main body 16*c* at a position slightly below the spring-fixing projection 16*j*. These component portions are formed integrally from synthetic resin. The insertion guide 16*k* is disposed so as to face the inner surface of the bottom portion 2*a* of the base 2 to form an upper surface of the opening 5*a* of the insertion path. The insertion guide 16K is provided so as to guide in the direction in which the inserting end portion 4*a* of the tongue plate 4 is inserted into the opening 5*a* of the insertion path.

The above-described inserting projection 16*i* includes a vertical wall 16*l* abutting against the lock operation end 13*d* of the lock member 13 at the time of locking being cancelled and pressing the lock member 13 in the direction in which the tongue plate is inserted, and an inclined surface 16*m* which is inclined with a falling gradient toward a rear side of the vertical wall 16*l* (i.e., right side in FIG. 14). The vertical wall 16*l* and the inclined surface 16*m* are formed integrally and connected together.

The above-described pair of sliding portions 16*a* and 16*b* are each formed into a prismatic configuration having a size of allowing the sliding portions to come in and out from the slide grooves 15*a* and 15*b* of the pair of side walls 2*b* and 2*c* of the base 2. A guide groove is formed at one side (for example, the lower side) of each slide groove 15*a*, 15*b* in such a manner that the guide groove is fitted in a lower edge of the opening of each sliding groove 15*a*, 15*b* with a small play therebetween. As a result, the guide groove prevents the sliding portions 16*a* and 16*b* from coming off from the slide grooves 15*a* and 15*b* after having been fitted therein, and is made to guide a reciprocating slide movement of the release button 16.

Next, a description will be given of function of the seat belt buckle 1 with reference to FIGS. 16 to 18.

FIG. 16 is a longitudinal cross sectional view showing a state before the inserting end portion 4*a* of the tongue plate 4 is inserted into the "opening of the insertion path" 5*a* of the seat belt buckle 1. In FIG. 16, reference numeral 21 denotes a lower case mounted at a lower half portion of the base 2. The lower case 21 and an upper case 22 mounted at an upper half portion of the base 2 form a main body case. An insertion opening 23 communicating with the opening 5*a* of the tongue plate insertion path 5*b* is formed at the front surface of the main body case. In a state before the inserting end portion 4*a* of the tongue plate 4 is inserted into the insertion opening 23, the ejector 6 moves forward to the slide guide hole 7 of the base bottom 2*a* and moves further to a front end of the engagement hole 9 due to spring force of the ejector spring 8 so as to close the slide guide hole 7 and the engagement hole 9. Further, the ejector 6 slips into a lower side of the end of the latch engagement end 17*i* of the latch 17 to raise the end of the latch swinging end 17*i* onto the upper surface of the ejector 6.

At this time, respective front ends of the pair of sliding portions 17*g* and 17*h* of the latch swinging end 17*i* slide on and contact respective concave arcuate rear surfaces of the pair of lock swinging ends 13*f* and 13*g* of the lock member 13, and spring force of the latch spring 20, which is applied in the direction in which the tongue plate is inserted, and also in the direction toward the lower side in FIG. 16 (that is, in the direction in which the ejector 6 is pressed from top to down), is applied to the front surfaces of the lock swinging ends 13*f* and 13*g*, thereby preventing shaking of the lock member 13. (Namely, at this time, the lock member is substantially fixed state.)

Next, when, as shown in FIG. 17, the inserting end portion 4*a* of the tongue plate 4 is inserted into the insertion path 5*b* via the insertion opening 23 of the buckle 1 and the opening 5*a*, first, the convex arcuate end of the inserting end portion 4*a* of the tongue plate 4 is engaged and fitted into the concave arcuate front end of the ejector 6. Thereafter, when the tongue plate 4 is further pushed inward, the ejector 6 moves back sliding on the bottom portion 2*a* of the base 2 against the spring force of the ejector spring 8. When the rear end (i.e., the end at the right side in FIG. 17) of the ejector 6 abuts against and presses the pair of leg portions 17*e* and 17*f* serving as the stoppers of the latch 17, backward movement of the ejector 6 is stopped and further insertion of the tongue plate 4 is restricted.

When the pair of leg portions 17*e* and 17*f* are pressed rearward by the ejector 6, the latch swinging end 17*i* of the latch 17 rotates in a counterclockwise direction around the central axes of swinging of the pair of lug-shaped shafts 17*b* and 17*c*.

At this time, the upper surface of the engagement hole 9 of the base 2 has been already opened by the backward movement of the ejector 6, and the engagement hole 4*b* of the tongue plate 4 coincides with the engagement hole 9 of the base 2. Therefore, the above-described rotating latch swinging end 17*i* is inserted into the overlapping holes 7 and 9. As a result, the tongue plate 4 is latched to the base 2.

At this time, the pair of lock swinging ends 13*f* and 13*g* of the lock member 13 pressed by the latch spring 20 in the direction in which the tongue plate is inserted, also rotate in a counterclockwise direction around the lug portions 13*b* and 13*c*. Therefore, the respective circular arc-shaped lower surfaces of the lock swinging ends 13*f* and 13*g* slide rearward in FIG. 17 on the flat surfaces of the pair of sliding portions 17*g* and 17*h* of the latch 17. As a result, the lower half portion of the rectangular end of the latch spring 20 abuts against the external surface of the hooked end of the latch sliding end 17*i* (bent portion of the latch sliding end 17*i* and presses the latch 17 in the direction in which the tongue plate is inserted and also press it toward the engagement hole 9 of the base 2, thereby a latched state is maintained.

Further, during the latched state, the lock swinging ends 13*f* and 13*g* of the lock member 13 are made upright on the pair of sliding portions 17*g* and 17*h* of the latch 17 in a state of tilting substantially forward with respect to the lug portions 13*b* and 13*c* serving as the central axes of swinging. The lock swinging ends 13*f* and 13*g* are urged rearward by the latch spring 20 located at the front side of the lock swinging ends 13*f* and 13*g*, and therefore, the latched state is locked firmly.

Moreover, respective ends of the pair of stopper portions 19*h* and 19*i* of the stopper 19 abut against respective upper ends of the pair of sliding portions 16*a* and 16*b* of the release button 16 during the locked state. Therefore, swinging of the lock member 13 without pressing the release button 16 can be prevented and shaking (unstability) of the lock member 13 can be prevented.

As shown in FIG. 18, in order to cancel the locked state, when the release button 16 is pressed, against the spring force of the latch spring 20, along the direction in which the tongue plate is inserted, the pair of sliding portions 16*a* and 16*b* of the release button 16 slides in the guide grooves 15*a* and 15*b* of the base 2 and moves along the direction in which the tongue plate is inserted. Therefore, the sliding portions 16*a* and 16*b* are separated from the pair of stopper portions 19*h* and 19*i* of the stopper 19 mounted in the lock member 13 and the stopper of the lock member 13 is disengaged.

When the release button 16 is pressed, the inserting projection 16*i* of the release button 16 is inserted into the insertion hole 13*h* of the lock operation end 13*d*. Therefore, the inclined surface 16*m* of the inserting projection 16*i* first abuts against the tapered surface 13*h* of the insertion hole 13.

Accordingly, accompanied with the inserting projection 16*i* being inserted into the insertion hole 13*h*, the entire lock member 13 (the pair of lock swinging ends 13*f* and 13*g*) is lifted toward an upper side in FIG. 18, that is, in a direction opposite to a direction in which the pair of lock swinging ends 13*f* and 13*g* press the pair of sliding portions 17*g* and 17*h* of the latch 17 toward the engagement hole 9 of the base 2, therefore, the pressing force is thereby reduced.

Thereafter, when the inserting projection 16*i* is further inserted, the vertical wall 16*l* of the inserting projection 16*i* abuts against the lock operation end 13*d*. When the lock operation end 13*d* moves further rearward than the central axes of swinging of the lug portions 13*b* and 13*c* of the lock member 13, the pair of lock swinging ends 13*f* and 13*g* rotate reverse (rotate clockwise direction) around the lug portions 13*b* and 13*c* toward the front side (toward left in FIG. 18) based on the principle of pendulum.

As a result, the circular arc-shaped lower surfaces 13*j* and 13*k* of the pair of lock swinging ends 13*f* and 13*g* slide forward and are separated from the pair of sliding portions 17*g* and 17*h* of the latch 17. Therefore, the latch swinging end 17*i* becomes free. Accordingly, the ejector 6 constantly pressed by the ejector spring 8 toward the front side (toward left in FIG. 18) pushes out the inserting end portion 4*a* of the tongue plate 4 within the tongue plate insertion path 5*b*, in a direction opposite to a direction in which the tongue plate is inserted (toward the front side (i.e., toward the left side in FIG. 18)). Therefore, the rear surface at the end of the latch swinging end 17*i* is pushed out from the front end of the engagement hole 4*b* of the tongue plate 4 and also pushed out upward in FIG. 18 from the tongue-shaped member 6*a* of the ejector. As a result, the latching is cancelled. Furthermore, at this time, the tongue plate 4 is strongly ejected from the insertion path 5*b* to the outside due to the spring force of the ejector spring 8 of the ejector 6.

On the other hand, during the locked state shown in FIG. 17, in a case in which the buckle 1 instantaneously pulls the tractive plate 11 by a tractor (not shown) toward the right side in FIG. 17 due to an instantaneous force such as explosion pressure of gunpowder, when looseness of the webbing inserted into the insertion hole 4*c* of the tongue plate 4 is removed substantially instantaneously due to pulling of the tractive plate and the webbing is thereby strained, the pulling operation is rapidly stopped and so-called reverse G occurs. In this case as well, according to the buckle 1, it is possible to prevent such a trouble as that may cause coming-off (ejecting) of the tongue plate 4 without the release button 16 being pressed.

In other words, according to the buckle 1, the lock swinging ends 13*f* and 13*g* of the lock member 13 locks the latch swinging end 17*i* which latches the tongue plate 4 by pressing the same in the direction in which the tongue plate is inserted (from the front side (i.e., from the left side in FIG. 17) toward the rear side (i.e., the right side in FIG. 17)) and also pressing toward the engagement hole 9 of the base 2. Therefore, when inertia force caused by rapid stopping of instantaneous pulling of the base 2 is generated, the inertia force acts on the lock swinging ends 13*f* and 13*g* from the front side to the rear side (in the direction in which the tongue plate is inserted) (i.e., the direction such that the latch swinging end 17*i* is pressed by the lock swinging ends 13*f* and 13*g*). As a result, the locked state can be rather reinforced.

Further, the center of gravity of the lock member 13 is located nearer the lock swinging ends 13*f* and 13*g* than the lock operation end 13*d*, the mass at the side of the lock swinging ends 13*f* and 13*g* is made heavier by the weight portion 13*e*. Therefore, the inertia force acting on the lock swinging ends 13*f* and 13*g* in the locking direction, can be made larger than the inertia force acting on the release button 16 in a direction in which locking is cancelled. Accordingly, the locked state of the latch 17 by the lock member 13 can be further firmly held, and therefore, coming-off (ejecting) of the tongue plate 4 can be reliably prevented, accordingly, safety can be improved so much.

Moreover, the lock swinging ends 13*f* and 13*g* of the lock member 13 for locking the latch state of the latch 17 is urged by the latch spring 20 in a direction in which the locked state is reinforced, that is, the direction in which the tongue plate is inserted, and the spring member which urges the latch 17 in a direction opposite to the direction in which the tongue plate is inserted, like a conventional structure, is not provided. Therefore, it is not necessary that the lock state of the latch be cancelled by pressing the release button 16 in the direction in which the tongue plate is inserted, against the spring force. Accordingly, pressing force of the release button, that is, release force can be reduced, and safety can be improved still further.

The pair of lug portions 13*b* and 13*c* of the lock member 13 can be simply inserted into the supporting holes 12*a* and 12*b* in such a manner that 13*b* and 13*c* are put in the open ends 14*c* and 14*d* of the pair of introduction grooves 14*a* and 14*b* of the side walls 2*b* and 2*c* of the base 2, and inserted in 12*a* and 12*b* along the introduction grooves 14*a* and 14*b*. That is, assembly workability when the lock member 13 is mounted in the base 2 can be improved.

Further, since the lock member 13 is entirely formed by press forming of a metal flat plate, both improvement in simplicity of manufacture and reduction in cost can be achieved as compared with a case in which the lock member is formed from, for example, sintered metal.

Furthermore, the lock swinging ends 13*f* and 13*g* sliding on the pair of sliding portions 17*g* and 17*h* of the latch swinging end 17*i* of the latch 17 are respectively formed at two places, i.e., at both transverse-direction ends of the lock member 13. Therefore, as compared with a case of sliding at one place, a sliding operation when the lock swinging ends 13*f* and 13*g* slide on the pair of sliding portions 17*g* and 17*h* located at both transverse-direction ends of the latch swinging end 17*i*, can be stabilized, and the locked state of the latch 17 by the lock member 13 can also be stabilized. As a result, safety can be improved.

The lock swinging ends 13*f* and 13*g* sliding on the sliding portions 17*g* and 17*h* of the latch swinging end 17*i* respectively have the circular arc-shaped lower sliding surfaces 13*j* and 13*k*. Therefore, each the contact area of the sliding surface decreases and sliding loss can be reduced. As a result, insertion force by which the tongue plate 4 is inserted into the insertion path 5*b* to allow swinging of the lock swinging ends 13*f* and 13*g*, and pressing force of the release button 16 (i.e., release force) can be reduced.

During release of the latch 17, respective front ends of the sliding portions 17*g* and 17*h* of the latch swinging end 17*i* abut against respective surfaces, for example, respective rear surfaces of the lock swinging ends 13*f* and 13*g* of the lock member 13, and rotate around the central axis of swinging of the latch swinging end 17*i*. The respective surfaces (sliding surfaces) of the lock swinging ends 13*f* and 13*g* are respectively formed as the concave arcuate surfaces 13*l* and 13*m*, and therefore, the front ends of the sliding portions 17*g* and 17*h* of the latch swinging end 17*i* can smoothly rotate around the central axes of swinging thereof in such a manner as to slide-contact the concave arcuate surfaces 13*l* and 13*m*. As a result, the sliding loss of the latch swinging end 17*i* can be reduced, and respective portions of the latch sliding portions are constantly made to slide-contact the surfaces (i.e., the concave arcuate surfaces) of the lock swinging ends 13*f* and 13*g*. Therefore, shaking of the latch swinging end 17*i* is prevented and a latch releasing operation can be stabilized.

Further, the lock member 13, the stopper 19, and the latch spring 20 are in advance assembled in such a manner that the stopper 19 made of synthetic resin is mounted in the lock member 13 and one end of the latch spring is engaged with the mounting notches 19*f* and 19*g* of the stopper 19, and the prefabricated component thus formed can be mounted in the base 2. As a result, the number of assembling processes of the seat belt buckle 1 can be reduced and assembly workability for the base can be improved.

The stopper 19 is made of synthetic resin having elasticity, and therefore, it can be mounted, by fitting, in the lock member 13 made of metal, simply, reliably, and rapidly. Further, by the latch spring 20 being inserted in and fixed to the mounting notches 19*f* and 19*g* of the stopper 19, the latch spring 20 can be simply and reliably mounted at a predetermined mounting position in the lock member 13 with high accuracy.

Further, the stopper portions 19*h* and 19*i* of the stopper 19 mounted in the lock member 13 abut against the sliding portions 16*a* and 16*b* of the release button 16 during locking. Therefore, it is possible to prevent the locking state from being cancelled due to shaking of the lock member 13 at the time of locking without pressing the release button 16. As a result, safety can be improved so much.

When the release button 16 is pressed, the inserting projection 16*i* of the release button 16 is gradually inserted into the through hole of the lock member 13 and the lock member 13 is gradually lifted by the inclined surface 16*m* of the inserting projection 16*i* in a direction opposite to the direction in which it presses toward the latch swinging end 17I side. After that pressing force is reduced, the lock member 13 and the lock swinging ends 13*f* and 13*g* are made to swing to a lock releasing position. Accordingly, the pressing force of the release button 16, i.e., release force can be further reduced.

Further, the pair of arms 16*f* and 16*g* of the release button 16 are formed in the transverse direction of the release button 16 so as to hold therein the side walls 2*b* and 2*c* of the base 2 from externally, and the sliding portions 16*a* and 16*b* located at respective ends of the arms 16*f* and 16*g* are made to slide into the slide grooves 15*a* and 15*b* formed as elongated holes in the base 2. Therefore, the sliding movement of the sliding portions 16*a* and 16*b* when the release button 16 is pressed, can be stabilized in the transverse direction of the release button 16 and can also be made smooth.

A guide groove is formed in each of the sliding portions 16*a* and 16*b* of the release button 16, each of which is slidably fitted into the respective slide grooves 15*a* and 15*b* of the base 2 so that the open edges of the slide grooves 15*a* and 15*b* are slidably fitted therein. Therefore, the open edge of the slide groove 15*a* (15*b*) can be slidably held by the pair of facing walls of the guide groove. As a result, coming-off of the sliding portions 16*a* and 16*b* from the slide grooves 15*a* and 15*b* can be prevented.

Moreover, the release button 16 is lightened by being entirely made substantially hollow by synthetic resin. Therefore, at the time of occurrence of so-called reverse G, the inertia force acting on the release button 16 in the direction in which the release button is pressed, can be remarkably made smaller than the inertia force acting on the lock swinging ends 13*f* and 13*g* of the lock member 13 in the locking direction. Accordingly, it is possible to prevent the tongue plate 4 from coming off (ejecting) from the buckle 1 without pressing the release button 16 at the time of occurrence of so-called reverse G. Further, safety can also be improved.

Figure 19:
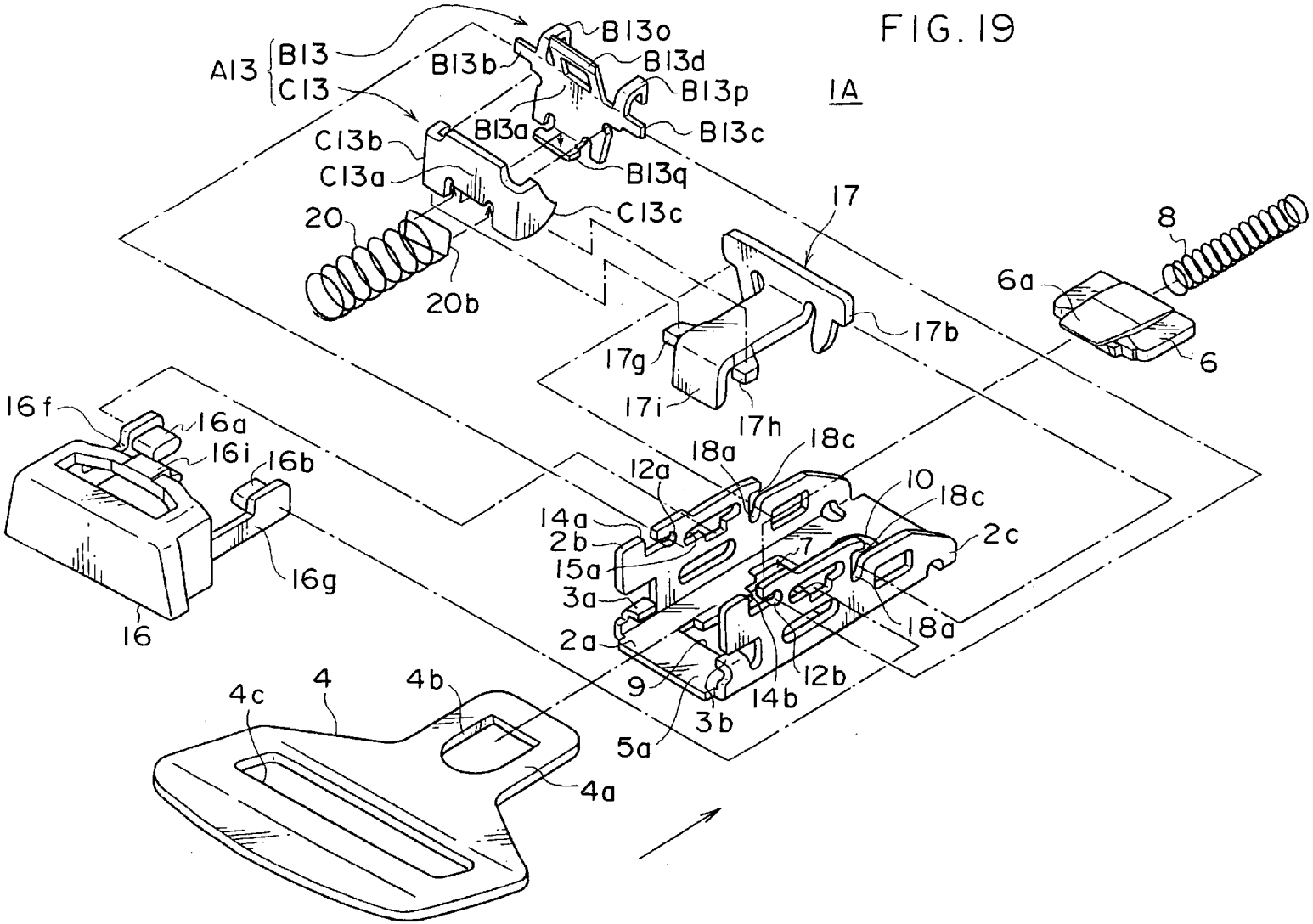
FIG. 19 is an exploded perspective view of a second embodiment of the present invention.

FIG. 19 is an exploded perspective view of a seat belt buckle 1A according to a second embodiment of the present invention. The seat belt buckle 1A has the substantially same structure as that of the above-described seat belt buckle 1 except that the lock member 13 (hereinafter, a first loch member 13) of the seat belt buckle 1 according to the first embodiment shown in FIG. 1 is changed to a second lock member A13 made of metal, which will be shown in FIGS. 20 to 22, and various functions of the stopper 13 made of resin shown in FIGS. 10 to 12 are assigned to the second lock member A13 and no stopper 13 is provided. A duplicate description will be omitted or simplified.

Figure 20:
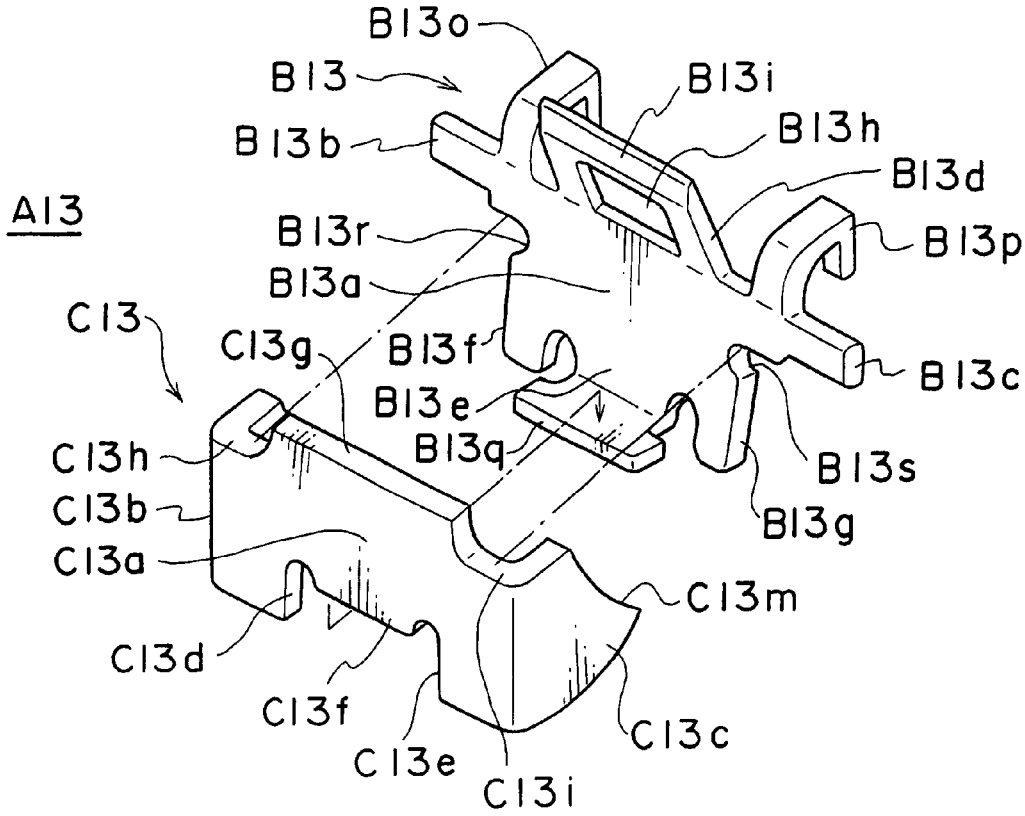
FIG. 20 is an exploded perspective view of a second lock member shown in FIG. 19.

Namely, as shown in FIG. 20, the second lock member A13 is formed in such a manner that a lock-member weight portion C13 made of metal is attachably and removably mounted by fitting at a front surface (i.e., the surface at the left side in FIG. 20) of a lock-member main body portion B13 made of metal.

Figure 21:
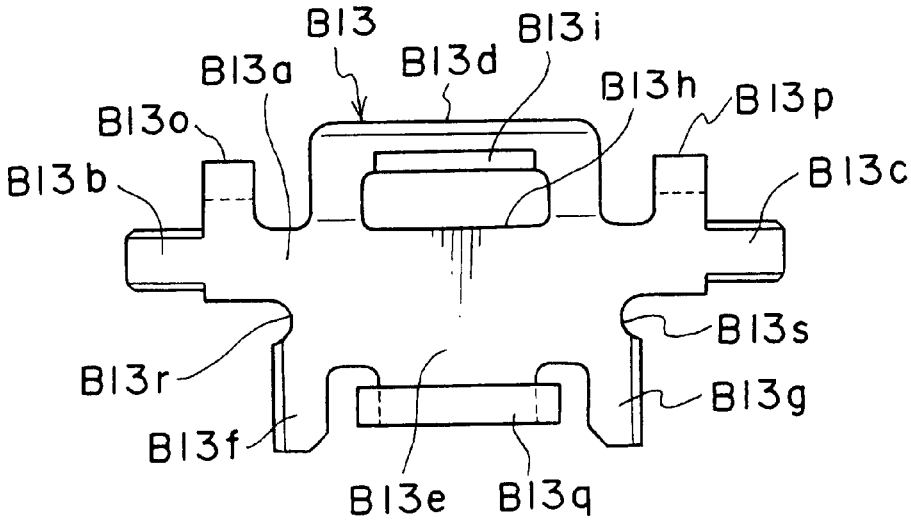
FIG. 21 is a front view of a main body of the second lock member shown in FIG. 20.
Figure 22:
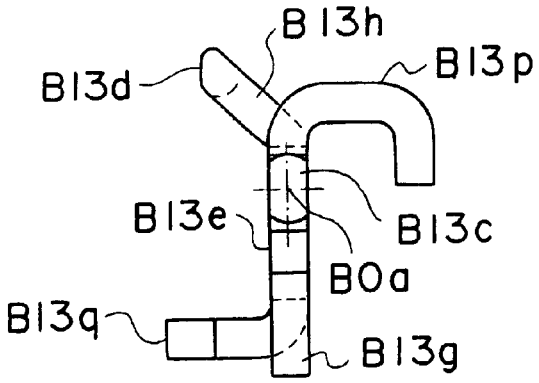
FIG. 22 is a side view of the lock member main body shown in FIG. 21.
Figure 23:
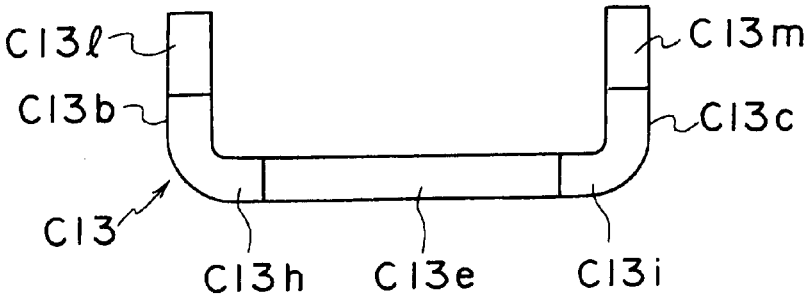
FIG. 23 is a plan view of a weight portion of the second lock member shown in FIG. 20.
Figure 24:
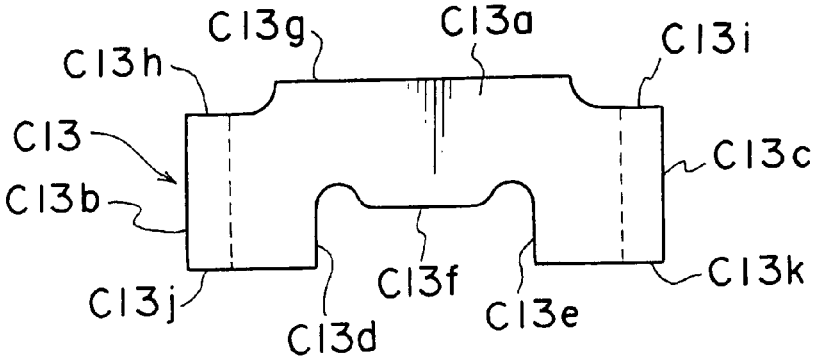
FIG. 24 is a front view of the lock member weight portion shown in FIG. 23.
Figure 25:
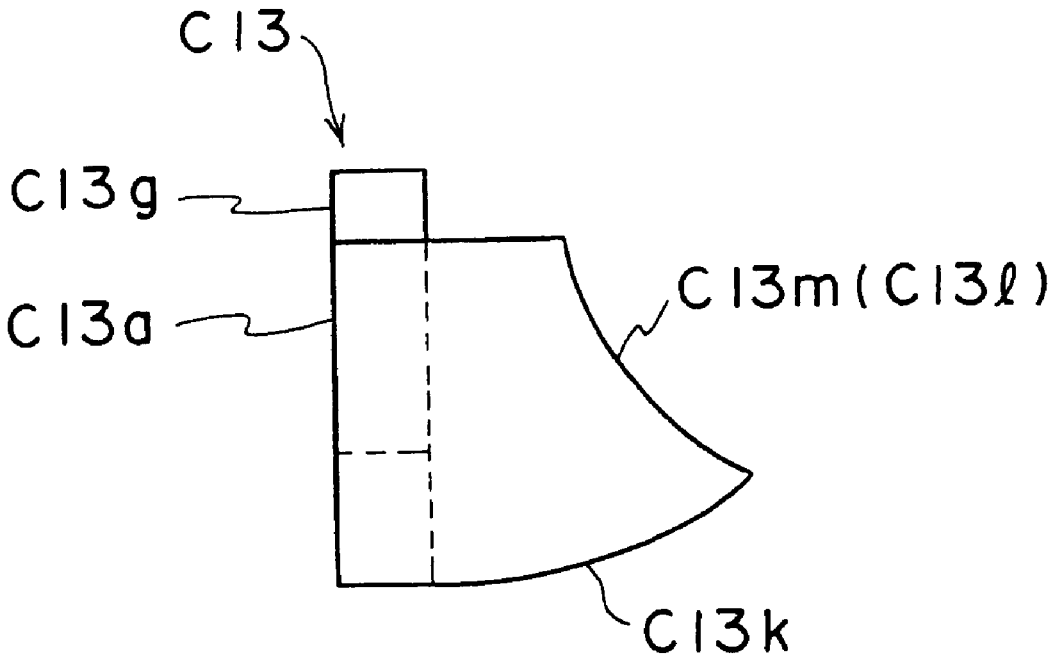
FIG. 25 is a side view of the lock member weight portion shown in FIG. 23.

As shown in FIGS. 21 and 22, the lock-member main body portion B13 is formed integrally by press forming of a metal flat plate in the same manner as in the first lock member 13 shown in FIGS. 8 and 9. That is, the lock-member main body portion B13 includes a rectangular main body B13*a* of which transverse dimension is longer than the vertical dimension and the transverse dimension is a little longer than the transverse dimension of the base 2, a pair of lug portions B13*b* and B13*c* formed integrally with both transverse-direction ends of the main body B13*a* and inserted swingably into the pair of circular supporting holes 12*a* and 12*b* of the base 2, a rectangular lock operation end B13*d* of which transverse dimension is longer than the vertical dimension and which protrudes toward the upper side in FIG. 21 from a transverse-direction intermediate portion at an upper end of the main body B13*a*, a weight mounting portion B13*e* formed substantially into a rectangle and protruding toward the lower side in FIG. 21 from the transverse-direction intermediate portion at a lower end of the main body B13*a*, a pair of lock swinging ends B13*f* and B13*g* protruding downward from both side portions (in FIG. 21) of the weight mounting portion B13*e*, and stopper portions B13*o* and B13*p* having the substantially same shapes as those of the pair of hooked stopper portions 19*h* and 19*i* in the stopper 19 shown in FIGS. 10 to 12. These component members are formed integrally and connected together.

The above-described lock operation end B13*d* includes, at the central portion thereof, a rectangular insertion hole B 13*h* of which transverse dimension is longer than the vertical dimension. A tapered surface B13*i* is formed in an open upper edge (in FIG. 21) of the insertion hole B 13*h* in such a manner an opening of the insertion hole 13*h* is widen toward the tongue plate insertion side (i.e., the left side in FIG. 22). Further, the lock operation end B13*d* is bent to be inclined at a predetermined angle at the front side (i.e., the left side in FIG. 22) with respect to the central axis of swinging BOa of the pair of lug portions B13*b* and B13*c*, that is, it is bent to inclined at the predetermined angle to the tongue plate insertion side.

The stopper portions B13*o* and B13*p* are formed at both transverse-direction ends of the main body B13*a* of the lock-member main body portion B13 (at the inner side of the pair of lug portions B13*b* and B13*c*), and are formed so as to protrude from the main body B13*a*. The respective hooked ends of the stopper portions protrude downward in FIG. 20, and abut against the upper end surfaces of the pair of sliding portions 16*a* and 16*b* of the release button 16 shown in FIGS. 14 and 15 at the time of locking. Accordingly, unless the sliding portions 16*a* and 16*b* are moved by pressing the release button 16 and are released from a state of abutting against both stopper portions B 13*o* and B 13*p*, it is possible to suppress swinging of the lock-member main body B13, namely, it is possible to prevent cancellation of the lock state.

Further, the lock-member main body portion B13 includes a rectangular jaw-shaped portion B13*q* which protrudes toward the side at which the lock-member weight portion C13 is mounted (the left side in FIG. 22) and which is formed integrally with a lower end of the weight mounting portion 13*e*. When the lock-member weight portion C13 is mounted, the bottom surface thereof is supported by the jaw-shaped portion B13*q* and an rectangular shaped end of the latch spring 20 is mounted at an end of the jaw-shaped portion B13*q* by external fitting. A pair of engaging concave portions B13*r* and B13*s* recessed inwardly are respectively formed at upper ends (in FIG. 21) of the pair of swinging ends B13*f* and B13*g* of the lock-member main body portion B13.

The lock-member weight portion C13 is formed integrally by press forming of a metal flat plate of which plate thickness is a little larger than the metal flat plate of the lock-member main body portion B13 in such a manner as to be attached and removably fitted in the lock-member main body portion B13.

In other words, as shown in FIGS. 20, 23, 24, and 25, the lock-member weight portion C13 includes a weight portion C13*a* formed into a substantially rectangular plate, a pair of lock sliding portions C13*b* and C13*c* bent substantially at a right angle so as to protrude toward the lock-member main body portion B13 at both ends of the weight portion C13*a*, a pair of spring-mounting notches C13*d* and C13*e* formed at the lower end (in FIG. 24) of the weight portion C13*a* and mounting to engage the rectangular shaped end 20*b* of the latch spring 20 therein, a bottom portion C13*f* which is formed into a horizontal flat surface which connects respective inner ends of the pair of spring-mounting notches C13*d* and C13*e* in the horizontal direction and which is placed and fixed on the jaw-shaped portion B13*q* of the lock-member main body portion B13, a rectangular head portion C 13*g* of which transverse dimension is longer than the vertical dimension and protruding upward (in FIG. 24) from the upper end surface of the weight portion C13*a*, and a pair of shoulder portions C13*h* and C13*i* provided at both transverse-direction sides (in FIG. 24) of the head portion C13*g*. These component members are formed integrally and connected together.

When the lock-member weight portion C13 is mounted on the lock-member main body portion B13, the pair of lock sliding portions C13*b* and C13*c* elastically hold both external side surfaces of the pair of swinging ends B13*f* and B13*g* of the lock-member main body portion B13 from both sides to the inside. Further, respective lower end surfaces (in FIG. 24) of the lock sliding portions C13*b* and C13*c* are formed as circular arc-shaped surfaces C13*j* and C13*k* protruding outward, and respective rear surfaces thereof (i.e., the surfaces at the side of the lock-member main body portion B13 in FIG. 20) are formed as concave arcuate surfaces C13*l* and C13*m* protruding inward. The circular arc-shaped surfaces C13*j* and C13*k* which are at the lower ends of the pair of lock sliding portions C13*b* and C13*c* slide on the upper surfaces of the pair of sliding portions 17*g* and 17*h* of the latch 17 shown in FIG. 6, and the respective angular portions at the front surfaces of the pair of sliding portions 17*g* and 17*h* of the latch 17 slide on the concave arcuate surfaces C13*l* and C13*m* which are at the rear side of the lock sliding portions C13*b* and C13*c*, respectively.

Accordingly, as shown in FIG. 20, the lock-member weight portion C13 is mounted in the lock-member main body portion B13 in such a manner that the lock-member weight portion C13 is pushed in and engaged with, from the front of the lock-member main body portion B13, a lower side with respect to the pair of lug portions 13*b* and 13*c* of the lock-member main body portion B13, that is, the lock swinging end side of the lock-member main body portion B13, at a predetermined mounting position at the front surface of the lock-member main body portion B13. The upper end of the head portion C13*g* of the lock-member weight portion C13 is located at a position below an open lower end of the insertion hole B13*h* of the lock-member main body portion B13, and the bottom portion C13*f* of the lock-member weight portion C13 is placed on and fixed to the jaw-shaped portion B13*q* of the lock-member main body portion B13. At this time, respective external side surfaces of the pair of swinging ends B13*f* and B13*g* of the lock-member main body portion B13 are elastically held by the pair of sliding portions C13*b* and C13*c* of the lock-member weight portion C13 from externally to the inside. Further, lower surfaces at both transverse-direction ends of the main body B13*a* of the lock-member main body portion B13 abut against the upper surfaces of the pair of shoulder portions C13*h* and C13*i* of the lock-member weight portion C13, and the entire lock-member weight portion C13 is elastically held by the both transverse-direction ends of the main body B13*a* and the jaw-shaped portion B13*q* of the lock-member main body portion B13 from both sides in the vertical direction in FIG. 24.

In other words, the lock-member weight portion C13 and the lock-member main body portion B13 are elastically held by each other both in the vertical and transverse directions. Further, engagement of the lock-member main body portion B13 and the lock-member weight portion C13 is held by engaging and fitting the rectangular end 20*b* of the latch spring 20 in the jaw-shaped portion B13*q* of the lock-member main body portion B13. Accordingly, the bonding strength between the lock-member main body portion B13 and the lock-member weight portion C13 increases greatly. Further, the lock-member weight portion C13 is formed by a metal flat plate of which thickness is larger than that of the lock-member main body portion B13, and therefore, the mass of the lock-member weight portion C13 can be made larger than that of the weight portion 13*e* of the above-described first lock member 13.

As a result, when so-called reverse G occurs, the mass of the second lock member A13 at the side of the lock swinging ends can be made still larger than the mass thereof at the side of the lock operation end B13*d*. Therefore, the inertia force acting on the lock member A13 in the locking direction can be further increased at the time of locking. Accordingly, safety of the seat belt buckle 1A can be improved still more. Further, the second lock member A13 has the structure in which the lock-member main body portion B13 and the lock-member weight portion C13 are formed separately, and therefore, mass-production of the main body portion B13 and the weight portion C13 with high accuracy can be archived by press forming of metal flat plates. Moreover, the lock-member main body portion B13, the lock-member weight portion C13, and the latch spring 20 are in advance assembled in such a manner that the lock-member weight portion C13 is mounted in the lock-member main body portion B13 and the rectangular end 20*b* of the latch spring 20 is mounted by externally fitting at an outer periphery of the end of the jaw-shaped portion B13*q* of the lock-member main body portion B13 protruding from the left side surface (in FIG. 22) of the lock-member main body portion B13 toward the left side in FIG. 22, and the prefabricated component comprised of the three portions can be formed as a prefabricated module (i.e., a composite component). As a result, the number of assembling processes of the seat belt buckle 1A decreases and assembly workability thereof can be improved.

As described above, according to the present invention, the latch swinging end of the latch for latching the tongue plate is locked by being pressed by the lock swinging ends of the lock member toward the engagement hole while being pressed (from the front side to the rear side) in the direction in which the tongue plate is inserted. Therefore, when so-called reverse G occurs, that is, when the inertia force is generated due to rapid stopping of instantaneous pulling of the base, the inertia force acts on the lock swinging ends (from the front side to the rear side) in the direction in which the tongue plate is inserted, that is, the direction in which the latch swinging end is pressed by the lock swinging ends at the time of locking such that lock state is increased. Accordingly, the lock state can be rather reinforced.

Further, the center of gravity of the lock member is located nearer the lock swinging ends than the lock operation end, and the mass at the side of the lock swinging ends is made larger by the weight portion. Therefore, the inertia force acting on the lock swinging ends in the locking direction can be made larger than the inertia force acting on the release button in the direction in which locking is released. Accordingly, the lock state of the latch can be held more firmly, and therefore, ejection of the tongue plate can be prevented reliably and safety can be improved so much.

Moreover, the lock swinging ends of the lock member for locking a latch state of the latch is urged by spring force of the latch spring in the direction in which the lock state is reinforced, that is, the direction in which the tongue plate is inserted, and no spring member for urging the latch in a direction opposite to the direction in which the tongue plate is inserted, is provided, unlike a conventional structure. Therefore, it is not necessary that the lock state of the latch be released by pressing the release button against the spring force in the direction in which the tongue plate is inserted. As a result, the pressing force of the release button, that is, release force can be reduced, and safety can be improved still more.

What is claimed is:

1. A seat belt buckle comprising:

a base including
- an insertion path in or from which a tongue plate having an engagement hole is inserted or removed,
- a pair of upright side walls, each of the side walls disposed at respective sides of the insertion path, and
- an engagement hole;

a latch including
- latch lug portions supported swingably by supporting portions formed in the side walls of the base, and
- a latch swinging end portion swinging between
  - a latch position at which, when the tongue plate is inserted to a latch position of the insertion path, the latch swinging end portion engagingly inserted into both of the engagement hole of the tongue plate and the engagement hole of the base so as to latch the tongue plate to the base, and
  - a latch release position at which a latched state is released;

a lock member including
- lug portions inserted rotatably into supporting holes formed in the side walls of the base, said holes having an opening at an external end of the side wall for receiving said lug portions,
- a lock swinging end portion swinging between
  - a lock position at which, at the time of the latched state, the lock swinging end portion latches the latch swinging end portion in a state in which the latch swinging end portion is pressed toward both of the engagement hole of the tongue plate and the engagement hole of the base while the lock swinging end portion is pressed in a direction in which the tongue plate is inserted, thereby locking the latched state, and
  - a lock release position at which a locked state is released;

a lock sliding portion swinging together with the lock swinging end, and during swinging, sliding on the latch swinging end;

a lock operation end portion which is located at the side opposite to the lock swinging end portion with respect to the lug portions interposed therebetween, and by which, when the lock operation end portion is pressed in the direction in which the tongue plate is inserted at the time of locking, the lock swinging end portion is made to swing to the lock release position, thereby releasing the lock state, and a weight portion by which a center of gravity of the lock member is located closer to the lock swinging end portion than the lug portions a latch spring elastically pressing, at the time of locking, the lock swinging end portion of the lock member substantially in the direction in which the tongue plate is inserted, to maintain the locked state;

a release button including
- sliding portions slidable with respect to the base in directions in and from which the tongue plate is inserted and removed, and a button which, when pressed against spring force of the latch spring in the direction in which the tongue plate is inserted, presses the lock operation end portion of the lock member in the direction in which the tongue plate is inserted, and causes the lock swinging end portion to swing in the direction from which the tongue plate is removed, thereby releasing the locked state; and an ejector which, when pressed by the tongue plate to a latch position, guides to fit the latch swinging end portion into the engagement hole of the tongue plate and the engagement hole of the base to allow latching and locking, and which, when the locked state is released by pressing the release button, presses the latch swinging end portion to the latch release position to release the latched state and removes the tongue plate from the insertion path of the base, wherein an inertial force acting on said lock member in said tongues plate insertion direction will be greater on said lock swinging end portion than on said lock operation end portion when said release button presses the lock operation end portion as a result of said force.

2. A seat belt buckle according to claim 1, wherein the supporting holes formed in the side wall of the base, into which the lug portions of the lock member are inserted, are each made circular, and at each of the side walls, an introduction groove is formed so as to communicate with the supporting hole and said opening at said external end of the side wall.

3. A seat belt buckle according to claim 1, wherein the lock member is structured in such a manner that the lug portions, the lock swinging end portion, the lock sliding portion, the lock operation end portion, and the weight portion are formed integrally by press forming of a metal flat plate.

4. A seat belt buckle according to claim 1, wherein the lock sliding portion includes two lock sliding portions which are respectively formed at both ends of the lock swinging end portion in a transverse direction of the lock member, and a sliding surface of each of the lock sliding portions, which slides on respective transverse-direction ends of the latch swinging end portion in directions in and from which the tongue plate is inserted and removed, is formed into a circular arc.

5. A seat belt buckle according to claim 1, wherein the lock sliding portion of the lock member includes a sliding surface which abuts against and slides on the latch swinging end portion when the latched state is released, and the sliding surface is formed as a circular-arc surface recessed inward.

6. A seat belt buckle according to claim 1, wherein the lock member is mounted on a stopper made of resin and having a spring-mounting notch portion, and one end of the latch spring is engaged with the spring-mounting notch portion of the stopper.

7. A seat belt buckle according to claim 6, wherein the stopper includes stopper portions formed integrally therewith and abutting against the sliding portions of the release button in the locked state.

8. A seat belt buckle according to claim 1, wherein the lock member comprises a lock-member main body portion including lug portions, lock swinging end portion, a lock operation end portion, and stopper portions abutting against the sliding portions of the release button in the locked state, all of which are formed integrally by press forming of a metal flat plate, and a lock-member weight portion including a weight portion and a pair of lock sliding portions located at both transverse-direction ends of the weight portion, the weight portion and the lock sliding portions being formed integrally by press forming of a metal flat plate, wherein lock-member main body portion further includes spring-mounting notch portion in which one end of the latch spring is engaged, and the lock-member weight portion is attachably-and-removably mounted in the lock-member main body portion.

9. A seat belt buckle according to claim 8, wherein the lock-member main body portion includes the stopper portions formed integrally therewith and abutting against the sliding portions of the release button in the locked state.

10. A seat belt buckle according to claim 8 or claim 9, wherein the lock sliding portions of the lock-member weight portion each include a sliding surface which slides on the latch swinging end portion in directions in and from which the tongue plate is inserted and removed, and each sliding surface is formed into a circular arc.

11. A seat belt buckle according to claim 1, wherein the lock member includes an insertion hole at the lock operation end portion, and the release button includes an inserting projection which is inserted into the insertion hole of the lock operation end portion at a time of pressing the release button, and at the same time, presses the lock operation end portion so as to swing the lock swinging end portion to the lock release position while gradually lifting the lock swinging end portion in a direction opposite to a direction in which it is pressed toward the latch swinging end portion.

12. A seat belt buckle according to claim 1, wherein the sliding portions of the release button are provided at respective ends of a pair of arms formed so as to hold therein the side walls of the base from externally, and a guide groove is formed in the each of the sliding portions in such a manner that an open edge of an elongated hole provided in each of the side walls of the base is slidably fitted therein.

13. A seat belt buckle according to claim 1, wherein the release button is entirely formed from synthetic resin.

14. A seat belt buckle comprising:

a base including an insertion path in or from which a tongue plate having an engagement hole is inserted or removed, and a pair of upright side walls, each of the side walls disposed at respective sides of the insertion path;

a latch supported swingably at the side walls of the base, and swinging between a latch position at which, when the tongue plate is inserted to a latch position of the insertion path, the latch engagingly inserted into the engagement hole of the tongue plate so as to latch the tongue plate, and a latch release position at which a latched state is released;

a lock member including lug portions and a lock swinging end portion swinging between a lock position at which, at the time of the latched state, the lock swinging end portion latches the latch in a state in which the latch is pressed toward the engagement hole of the tongue plate while the lock swinging end portion is pressed in a direction in which the tongue plate is inserted, thereby locking the latched state, and a lock release position at which a locked state is released;

a lock sliding portion swinging together with the lock swinging end, and during swinging end, and during swinging, sliding on the latch;

a lock operation end portion by which, when the lock operation end portion is pressed in the direction in which the tongue plate is inserted at the time of locking, the lock swinging end portion is made to swing to the lock release position, thereby releasing the locked state, and a weight portion by which a center of gravity of the lock member made eccentric to a lock swinging end portion side;

a latch spring elastically pressing, at the time of locking, the lock swinging end portion of the lock member substantially in the direction in which the tongue plate is inserted, to maintain the locked state;

a release button including a button which presses the lock operation end portion of the lock member in the direction in which the tongue plate is inserted, and causes the lock swinging end portion to swing in the direction from which the tongue plate is removed, thereby releasing the locked state; and an ejector which, when the locked state is released by pressing the release button, presses the latch to the latch release position to release the latched state and removes the tongue plate from the insertion path of the base, wherein the supporting holes formed in the side wall of the base, into which the lug portions of the lock member are inserted, are each made circular, and at each of the side walls, an introduction groove is formed so as to communication with the supporting hole and have an opening at an external end of the side wall.

15. A seat belt buckle comprising:

a base including an insertion path in or from which a tongue plate having an engagement hole is inserted or removed, and a pair of upright side walls, each of the side walls disposed at respective sides of the insertion path;

a latch supported swingably at the side walls of the base, and swinging between a latch position at which, when the tongue plate is inserted to a latch position of the insertion path, the latch engagingly inserted into the engagement hole of the tongue plate so as to latch the tongue plate, and a latch release position at which a latched state is released;

a lock member including a mounting portion for pivotally mounting said lock member to said base;

a lock swinging end portion swinging between a lock position at which, at the time of the latched state, the lock swinging end portion latches the latch in a state in which the latch is pressed toward both of the engagement hole of the tongue plate while the lock swinging end portion is pressed in a direction in which the tongue plate is inserted, thereby locking the latched state, and a lock release position at which a locked state is released;

a lock sliding portion swinging together with the lock swinging end, and during swinging, sliding on the latch;

a lock operation end portion by which, when the lock operation end portion is pressed in the direction in which the tongue plate is inserted at the time of locking, the lock swinging end portion is made to swing to the lock release position, thereby releasing the locked state, and a weight portion by which a center of gravity of the lock member is made eccentric to a lock swinging end portion side;

a latch spring elastically pressing, at the time of locking, the lock swinging end portion of the lock member substantially in the direction in which the tongue plate is inserted, to maintain the locked state;

a release button including a button which presses the lock operation end portion of the lock member in the direction in which the tongue plate is inserted, and causes the lock swinging end portion to swing in the direction from which the tongue plate is removed, thereby releasing the locked state; and an ejector which, when the locked state is released by pressing the release button, presses the latch to the latch release position to release the latched state and removes the tongue plate from the insertion path of the base, wherein the lock sliding portion of the lock member includes a sliding surface which abuts against and slides on the latch swinging end portion when the latched state is released, and the sliding surface is formed as a circular-arc surface recessed inward.

16. A seat belt buckle comprising:

a base including an insertion path in or from which a tongue plate having an engagement hole is inserted or removed, and a pair of upright side walls, each of the side walls disposed at respective sides of the insertion path;

a latch supported swingably at the side walls of the base, and swinging between a latch position at which, when the tongue plate is inserted to a latch position of the insertion path, the latch engagingly inserted into the engagement hole of the tongue plate so as to latch the tongue plate, and a latch release position at which a latched state is released;

a lock member including a lock swinging end portion swinging between a lock position at which, at the time of the latched state, the lock swinging end portion latches the latch in a state in which the latch is pressed toward the engagement hole of the tongue plate while the lock swinging end portion is pressed in a direction in which the tongue plate is inserted, thereby locking the latched state, and a lock release position at which a locked state is released;

a lock sliding portion swinging together with the lock swinging end, and during swinging, sliding on the latch;

a lock operation end portion by which, when the lock operation end portion is pressed in the direction in which the tongue plate is inserted at the time of locking, the lock swinging end portion is made to swing to the lock release position, thereby releasing the locked state, and a weight portion by which a center of gravity of the lock member is made eccentric to a lock swinging end portion side;

a latch spring elastically pressing, at the time of locking, the lock swinging end portion of the lock member substantially in the direction in which the tongue plate is inserted, to maintain the locked state;

a release button including a button which presses the lock operation end portion of the lock member in the direction in which the tongue plate is inserted, and causes the lock swinging end portion to swing in the direction from which the tongue plate is removed, thereby releasing the locked state; and an ejector which, when the locked state is released by pressing the release button, presses the latch to the latch release position to release the latched state and removes the tongue plate from the insertion path of the base, wherein the lock member is mounted on a stopper made of resin and having a spring-mounting notch portion, and one end of the latch spring is engaged with the spring-mounting notch portion of the stopper.

* * * * *